US006843375B2

(12) United States Patent
Scheidemann et al.

(10) Patent No.: US 6,843,375 B2
(45) Date of Patent: Jan. 18, 2005

(54) MAGNETIC SEPARATOR FOR LINEAR DISPERSION AND METHOD FOR PRODUCING THE SAME

(75) Inventors: Adi A. Scheidemann, Seattle, WA (US); Kem Robinson, Bellevue, WA (US); Patrick L. Jones, Seattle, WA (US); Stephen C. Gottschalk, Woodinville, WA (US)

(73) Assignees: The University of Washington, Seattle, WA (US); STI Optronics, Inc., Bellevue, WA (US)

( * ) Notice: Subject to any disclaimer, the term of this patent is extended or adjusted under 35 U.S.C. 154(b) by 185 days.

(21) Appl. No.: 10/052,891

(22) Filed: Jan. 18, 2002

(65) Prior Publication Data

US 2002/0162774 A1 Nov. 7, 2002

Related U.S. Application Data

(63) Continuation of application No. 09/469,662, filed on Dec. 22, 1999, now abandoned, which is a division of application No. 09/325,936, filed on Jun. 4, 1999, now Pat. No. 6,182,831, which is a continuation of application No. PCT/US98/21000, filed on Oct. 6, 1998.

(60) Provisional application No. 60/061,394, filed on Oct. 7, 1997.

(51) Int. Cl.[7] ..... B03C 1/00; H01J 49/30

(52) U.S. Cl. ..... 209/213; 209/223.1; 250/298; 250/294

(58) Field of Search ..... 209/213, 215, 209/223.1; 250/281, 294, 298, 299

(56) References Cited

U.S. PATENT DOCUMENTS

| | | | | |
|---|---|---|---|---|
| 2,777,958 A | | 1/1957 | Le Poole | |
| 3,308,293 A | | 3/1967 | Mathams | |
| 3,659,236 A | | 4/1972 | Whitehead, Jr. | |
| 4,078,176 A | * | 3/1978 | Matsuda | 250/296 |
| 4,745,281 A | | 5/1988 | Enge | |
| 4,973,840 A | | 11/1990 | Srivastava | |
| 5,049,755 A | | 9/1991 | Stenbacka, deceased et al. | |
| 5,073,713 A | | 12/1991 | Smith et al. | |
| 5,108,933 A | | 4/1992 | Liberti et al. | |
| 5,317,151 A | * | 5/1994 | Sinha et al. | 250/298 |
| 5,391,870 A | * | 2/1995 | Purser | 250/298 |
| 5,457,324 A | | 10/1995 | Armour et al. | |
| 5,723,862 A | * | 3/1998 | Forman | 250/294 |
| 6,043,488 A | * | 3/2000 | Bahatt et al. | 250/294 |
| 6,639,227 B1 | * | 10/2003 | Glavish et al. | 250/492.2 |

* cited by examiner

*Primary Examiner*—Donald R. Wals
*Assistant Examiner*—Matthew J. Kohner
(74) *Attorney, Agent, or Firm*—Christensen O'Connor Johnson Kindness PLLC

(57) ABSTRACT

A magnetic sector for charged particle beam transport that includes a magnetic field profile that achieves a linear dispersion from a collimated beam of charged particles proportional to their mass-energy-to-charge ratio. In one embodiment, the field profile necessary for the linear dispersion is obtained by the use of shaped, highly permeable poles powered by permanent magnets or electromagnetic coils.

25 Claims, 15 Drawing Sheets

MAGNETIC SEPARATOR FOR LINEAR DISPERSION AND METHOD FOR PRODUCING THE SAME

CROSS-REFERENCE TO RELATED APPLICATIONS

This application is a continuation of U.S. patent application Ser. No. 09/469,662, filed Dec. 22, 1999, now abandoned, which is a divisional of U.S. patent application Ser. No. 09/325,936, filed Jun. 4, 1999, now U.S. Pat. No. 6,182,831 B1, issued Feb. 6, 2001; which is a continuation of international application Ser. No. PCT/US98/21000, filed Oct. 6, 1998, which is a continuation-in-part of U.S. provisional patent application Ser. No. 60/061,394, filed Oct. 7, 1997, priority of the filing dates of which is hereby claimed under 35 U.S.C. §§ 112 and 119, respectively. Each of these applications is incorporated herein by reference.

FIELD OF THE INVENTION

This invention relates to applications of charged particles transport where a dispersion of the particles is desired by either a function of mass, energy or charge. More particularly, the invention relates to charged particle separation including, but not limited to, mass or energy spectrometers.

BACKGROUND OF THE INVENTION

In many applications in the manipulation of charged particle beams, the separation of the constituents of the beam by their mass, energy or charge is required. Magnet separators or sectors are often used to achieve this. Such magnet separators are used in mass and energy spectrometers. These magnet separators employ uniform fields perpendicular to the incident charged particle. Those skilled in the art of magnetic design go to great lengths to ensure uniformity. Charged particles in a uniform field follow curved trajectories. The trajectory that a charged particle with a mass m, an energy E, and a net charge q follows is given by the following equation:

$$R^2 = C\frac{1}{B^2}\left(\frac{mE}{q}\right) \tag{1}$$

Where R is the radius of the trajectory of the charged particle, or radius of curvature of the charged particle, and C is a constant of proportionality dependent upon the units of the parameters. The dependence of the square of the radius of curvature R in Equation (1) upon the mass-energy-to-charge ratio mE/q results in a dispersion of the charged particles entering into a uniform field according to the square root of their various mE/q ratios.

Depending upon the specific charged-particle separation application, many adaptations and embodiments of the uniform field magnet separator are employed. Mass spectrometers, for example, may use uniform magnet separators with permanent magnets or electromagnets to achieve a spatial separation of ions according to their mass and charge when accelerated to a fixed energy. The advantage of the uniform magnetic separator is that for a collimated charged particle beam it provides a focus along a plane parallel to the magnetic field along which the particles of all mE/q are focused. This plane lies at an angle of 45 degrees from the initial input beam trajectory. That is to say, that the trajectories of parallel charged particles of equivalent mE/q converge after the particles have followed an arc of their trajectories of 135 degrees from initial contact with the magnetic field. The disadvantage of the uniform field magnetic sector is that the separation of adjacent particles with mE/q differing by fixed amounts is a non-linear function of position. That is to say, larger mass-energy-to-charge ratios lie significantly closer than lower ratios.

For non-collimated charged particle beams, the uniform-field magnet sector is often modified to include a transverse gradient which provides focusing to compensate for the non-collimation.

SUMMARY OF THE INVENTION

Accordingly, an object of the present invention to provide a magnetic separator for charged particle beam separation that provides a focused linear or nearly linear dispersion of the charged particles proportional to their charge-to-mass or energy ratio along a plane.

Another object of the present invention is to provide a magnetic separator for charged particle separation that employs an inhomogeneous magnetic field in one plane and a homogeneous magnetic field in another for a linear dispersion of mass-energy-to-charge separation along a plane.

Another object of the present invention is to provide a magnetic separator with inhomogeneous fields providing a linear or near linear mass-energy-to-charge ratio focus dispersion beams along a plane parallel to the magnetic field with an additional transverse gradient magnetic field providing focusing for uncollimated charged particle beams.

According to a second aspect, the invention is a method for producing the required inhomogeneous field with causes collimated charged particles of varying mass-energy-to-charge ratios to be focused onto a plane with a separation of the various species directly proportional to their respective mass-energy-to-charge ratios.

According to a third aspect, the invention is a method of producing inhomogeneous fields providing a linear mass-energy-to-charge ratio focus dispersion along a plane parallel to the magnetic field with an additional transverse gradient magnetic field providing focusing for uncollimated charged particle beams.

According to one aspect, the invention comprises a magnet having two poles made of magnetically soft permeable material spaced apart to define a gap therebetween. Each pole extends parallel to the axis in the transverse direction. In the other direction the gap between the poles enlarges. In one embodiment, the enlargement is symmetrical. The gap increases along the axis at a rate such that the field decreases at a given rate as a function of the distance from entrance of the magnet. The magnetic field created within the gap between the poles subjects collimated charged particles injected into gap to follow a curved trajectory. The changing gap subjects these charged particles to a varying magnetic field as they execute curved trajectories. This varying magnetic field is determined by the profile of the poles and is chosen such that along a specific transverse plane perpendicular to the plane of symmetry between the poles the charged particles are focused according to a linear separation dispersion according to their mass-energy-to-charge ratio.

The poles receive magnetic induction by either electrical, or by permanent fully polarized hard magnetic material such as ferrite or rare-earth permanent magnets (REPM). This creates a magnetic field between the poles. A flux return yoke consisting of highly permeable soft magnetic material may be present to enhance the efficiency of the magnetic circuit. The overall shape of the magnetic separator can either be rectilinear or curved to follow the curved charged particle trajectories and minimize the mass of the sector. Likewise, in order to reduce the total sector weight specific high energy product rare-earth permanent magnet (REPM) materials such as classes known as neodymiumiron-boron (NdFeB) or samarium-cobalt (SmCo) may be used. The pole and yoke material may be made from iron cobalt alloys commonly known as vanadium permendur and described in the ASTM Specification A801.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1A:
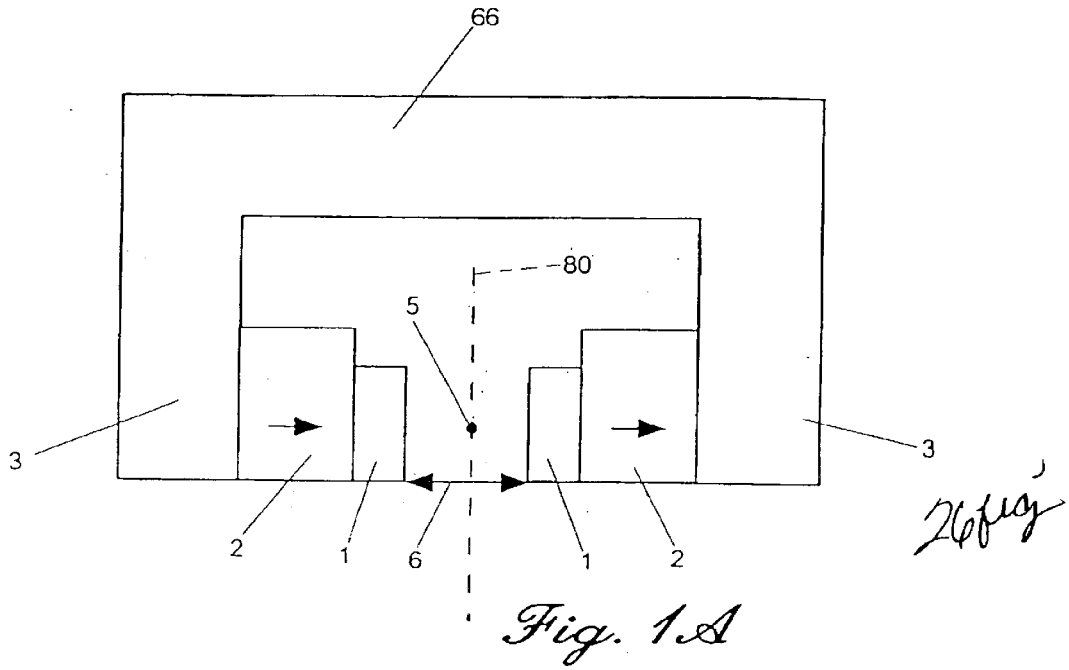
FIG. 1A is a schematic diagram of a permanent magnet sector with a uniform field known in the prior art which results in a square-foot mass-energy-to-charge ratio dispersion of charged particles.

FIG. 1A is a schematic diagram of a permanent magnet separator with a uniform field in two planes known in the prior art which results in a square-root mass-energy-to-charge ratio dispersion of charged particles. It consists of two high magnetically permeable parallel poles 1 made from suitable iron alloy such as vanadium permendur with magnets 2 made from a suitable ferrite or rare-earth permanent magnet (REPM) such as neodymium iron boron. A high magnetically permeable yoke 3 completes the magnetic circuit by connecting the magnets 2. The gap 6 between the poles is carefully held parallel and symmetric about a center axis 80 in a plane transverse to the axis 5 and along the axis 5. The number and disposition of the permanent magnets 2 within the magnetic circuit is varied and they may be located anywhere within the magnetic flux path 3 and may even be incorporated into the back portion of the return yoke 66. The magnetic return yoke 3 and back yoke 66 are not required, but generally used as they enhance the efficiency and strength of the magnetic field within the gap 6 between the poles 1.

Figure 1B:
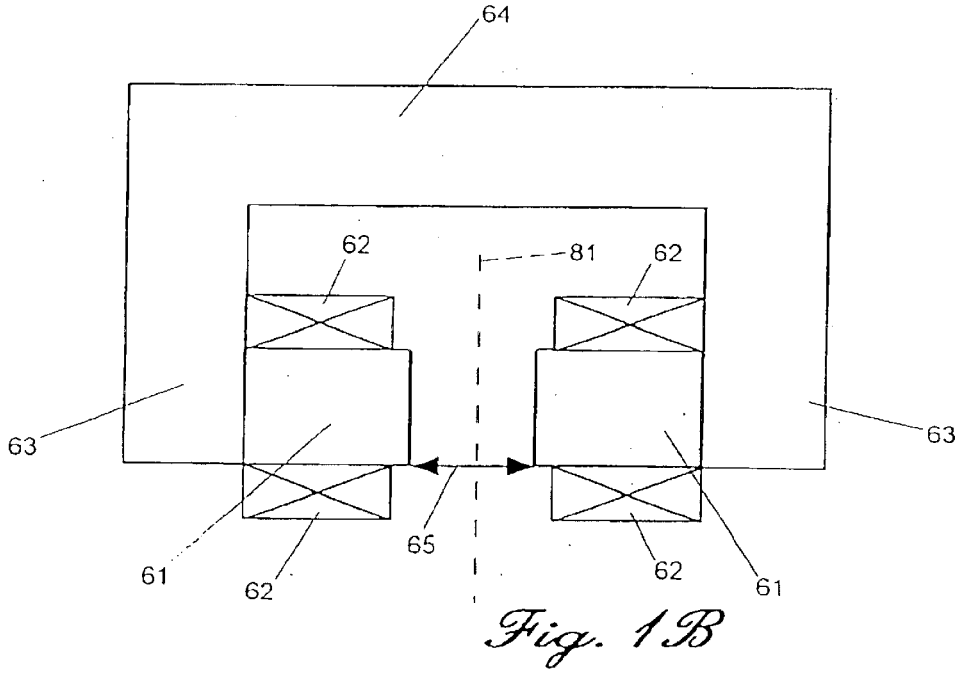
FIG. 1B is a schematic cross section diagram of a uniform-field magnet sector known in the prior art powered by electromagnets.

FIG. 1B is a schematic cross section diagram of a uniform-field magnet separator known in the prior art powered by electromagnets. Similarly to the prior art shown in FIG. 1A, highly magnetic permeable poles 61 are parallel and are separated by a gap 65 and disposed symmetrically about a center axis 81. The return path for the magnetic flux is through the highly magnetic permeable yoke pieces 63 and the back yoke 64. The magnetic field is generated by coils 62 which surround the part of the magnetic circuit and are shown in cross-section. The coils 62 may be located anywhere around the magnetic circuit either surrounding the poles 61, the yoke 63, or back yoke 64. There may be single or multiple coils 62 depending upon the specific requirements of the application.

The resulting magnetic field B present between the poles 1 in FIG. 1A or 61 in FIG. 1B is highly uniform and is used to cause a separation of charged particles as a function of their mass, energy or charge. A collimated charged particle beam incident on the axis will experience a transverse acceleration and follows along a curved trajectory governed by Equation (1). The collimated charged particles are focused along a plane parallel to the magnetic field and at 135 degrees from the incident angle. The variation in the dispersion of the focuses in a given uniform field results in a square root dependence along a plane perpendicular to the face of the poles 1 in FIG. 1A or 61 in FIG. 1B.

Figure 1C:
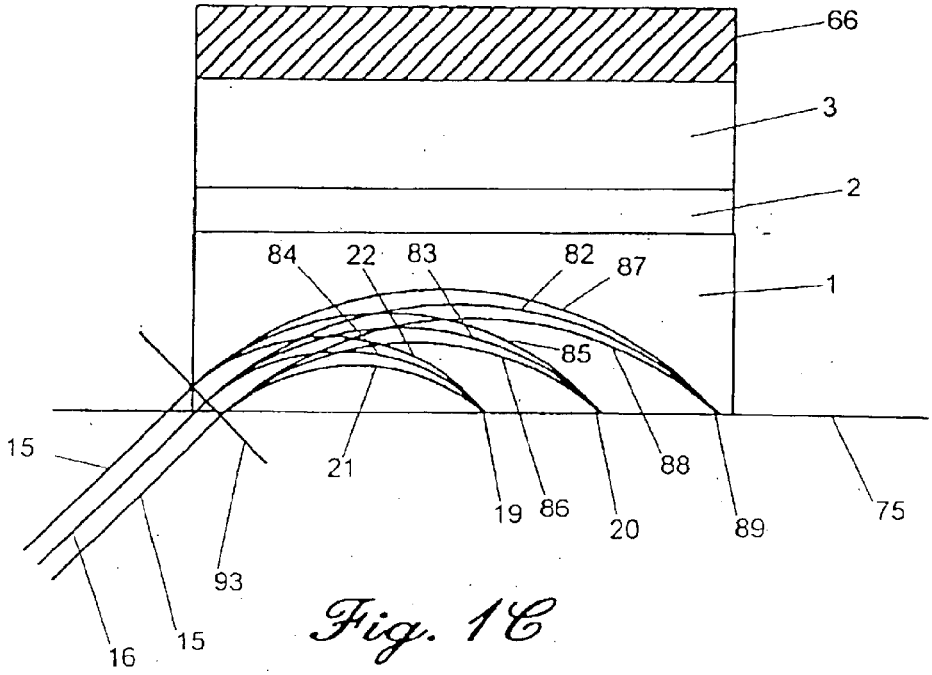
FIG. 1C is a schematic cross section diagram of a uniform field permanent magnet sector known in the prior art showing trajectories of charged particles subject to the field it produces.

FIG. 1C is a schematic cross-section diagram of a prior art uniform field magnet separator or sector. FIG. 1C is the perpendicular cross-section view of FIG. 1A. The poles 1 produce a uniform magnetic field resulting from the permanent magnets 2 with the magnetic circuit being closed by the return flux yoke 3 and back yoke 66. The magnetic field causes collimated charged particles 16 to follow circular paths 82, 83, and 84 with radii determined by Equation (1). The charged particles 15 that are offset from the central charged particles 16 are bent a corresponding amount 21, 85, 86, 87, 88, and 22. This results in all particles of equivalent mE/q converge along a single plane 75 perpendicular to the uniform field direction at locations 19, 20, and 89 corresponding to the relative change of $(mE/q)^{1/2}$. The collimated charged particles 16 and 15 enter the magnet sector at an angle of 135 degrees from the focus plane. The uniform magnet sector is often cut along this angle 93 so that the charged particles enter the magnet perpendicular to a pole edge.

Figure 2:
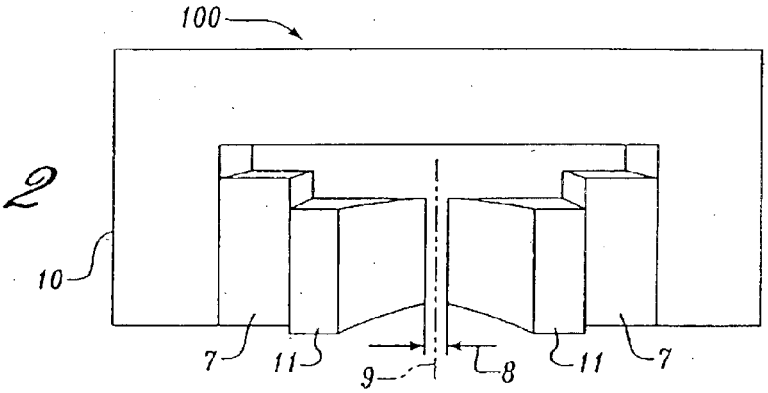
FIG. 2 is a schematic isometric diagram of a representative linear dispersion magnetic separator according to the present invention.

FIG. 2 is schematic isometric diagram of a representative linear dispersion magnetic separator according to the present invention. In this embodiment, the magnetic separator 100 includes a pair of highly magnetically permeable poles 11 that are placed parallel to each other with respect to a plane 9 bisecting the gap 8 separating the poles. The poles receive magnetic induction from permanent magnets 7 which are either ferrite or REPM. The gap between the poles 8 is not constant, but a function of the position along the centerline plane 9. As is the case with the uniform-field magnet separator, the magnetic circuit can be completed between the magnets by a high magnetically permeable yoke 10, but such a yoke is not a requirement of the present invention.

Figure 3:
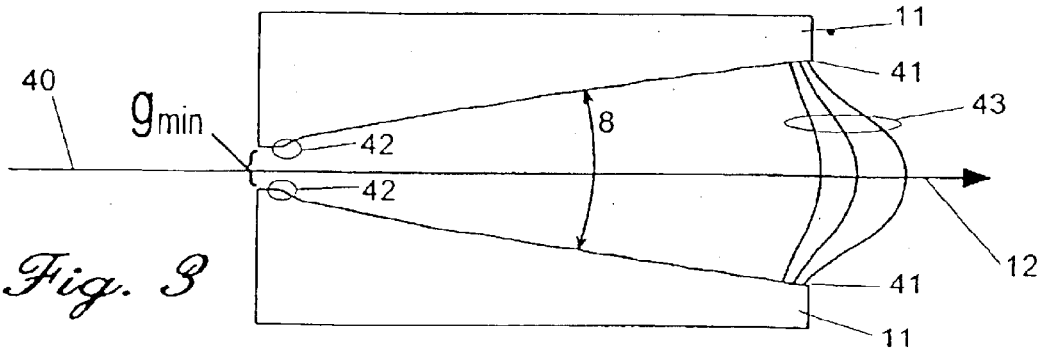
FIG. 3 is a detail view of the pole pieces showing an example profile required for a linear dispersion magnetic separator.

FIG. 3 is a detail view of the pole pieces showing an example profile required for a linear dispersion magnetic separator. The view is perpendicular to the view in FIG. 3. As shown in FIG. 3, the gap 8 between the poles 11 changes symmetrically along the length of the centerline plane 12 bisecting the gap. The change in the local gap of the poles 11 is chosen such that the magnetic field changes according to a predetermined dependence along the centerline 12. The dependence is done by integrating the charged particles equations of motion in a target magnetic field and comparing that to the desired characteristics of a focus on a plane with a linear-dispersion of various mass-energy-to-charge ratios. A functional dependence which gives rise to a linear dispersion of mE/q along a plane is that the magnetic field changes to the three-fourths power with respect to the centerline axis 12$x$.

$$B(x)=B_o x^{-3/4} \tag{2}$$

The field constant $B_o$ is chosen to match the nominal field. The local gap between the poles must follow a specific mathematical dependence in order to achieve the field dependence of Equation (2). It is obtained by modeling the pole surfaces as magnetic constant potential surfaces. The required profile for constant potential surface poles is given by $$g(x)=x\tan(x^{-1/4}) \tag{3}$$

Where g(x) is the local gap between the poles at a distance x from the beginning of the magnet. In actual practice a finite minimum gap 40 in FIG. 3 is necessary to permit the passage of the charged particles and so to compensate for this minimum and so small deviations from the perfect profile dictated by Equation (3) may be required. Likewise, in practice, a magnet will be of a finite length and the pole profile will also need to deviate from Equation (3) at the trailing pole ends 41 if the proper field dependence is desired to the trailing edge of the magnetic separator. At this location fringing of the magnetic fields 43 will cause the magnetic field to reduce faster than the dependence of Equation (2) near the proximity of the trailing pole edge 41 unless the pole profile deviates slightly from the required theoretical profile. The leading pole edge 42 represents the point of initial gap increase. The necessary adjustment of the pole profile is easily accomplished by one skilled in the art and is commonly done for uniform-field magnet separators.

Figure 4A:
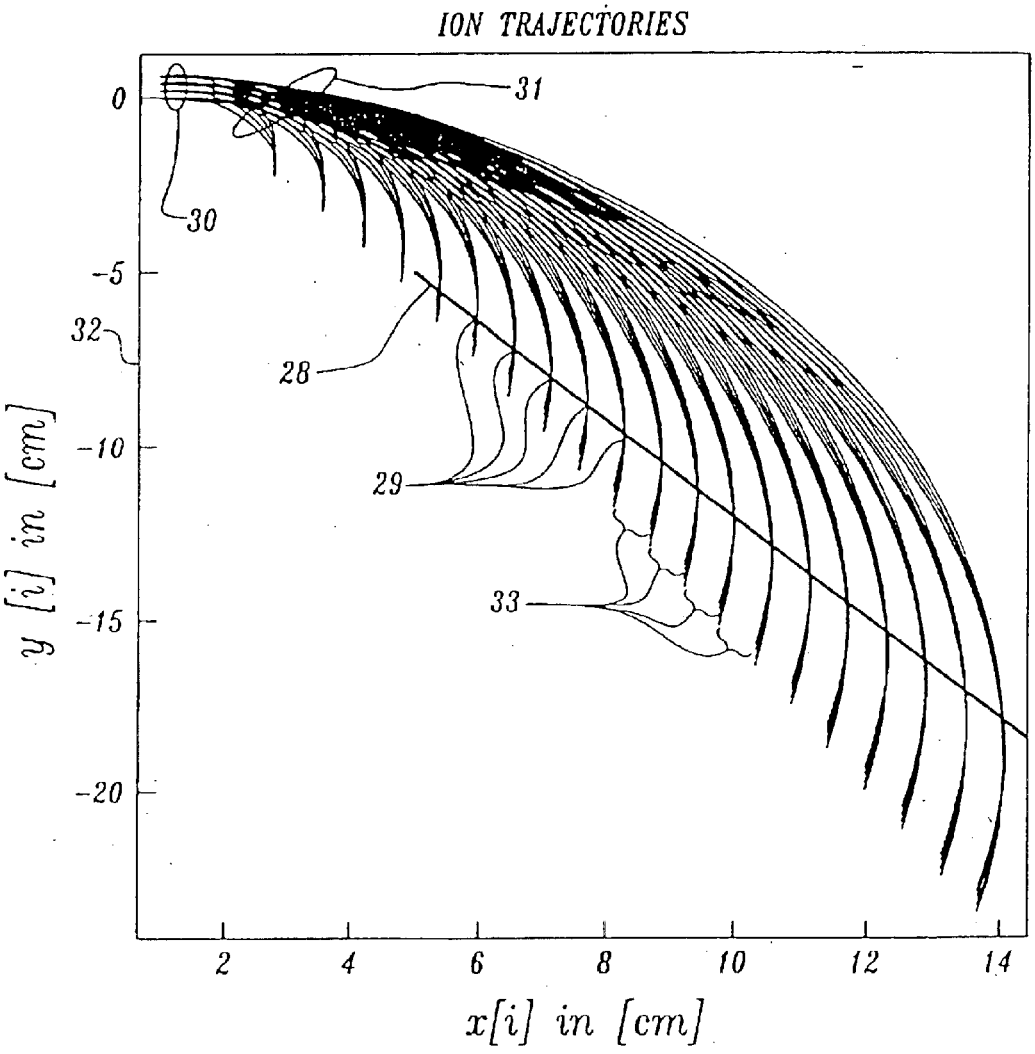
FIG. 4A is a graph of the trajectory and focusing position of charged particles with a constant energy and various masses traversing a representative linear dispersion magnet.

Whereas in a uniform magnetic field, charged particles undergo circular trajectories given by Equation (1), in an inhomogeneous field, as given in Equation (2), the charged particles undergo trajectories with ever-changing radii of curvature. FIG. 4A is a graph of the trajectory and focusing position of charged particles with a constant energy and various masses traversing an example linear dispersion magnet. The incident-charged particles have initial parallel entrance angles but are displaced transversely 30 along the y axis 32. They execute the trajectories 31 in a fashion similar to that of charged particles in a uniform field. That is, the collimated charged particles incident on the inhomogeneous field with the required field dependence of Equation (2) are focused at points 29 along their trajectory. The surface defined by joining the focus points 29 forms a plane parallel to the magnetic field and perpendicular to the midplane of the magnet shown in FIG. 2 (9). The distance 33 between the focus points of the charged particles is directly proportional to the fractional change of the mass-energy-to-charge ratio. If the mE/q differs by fixed amounts the separation of focus points along the focal plane 33 is constant. This is in direct contrast to the uniform-field magnet sector where the separation between charged particles of differing mass-energy-to-charge ratio is proportional to the square root of the fractional change in the ratios. The example data plotted in FIG. 4A is for a family of charged particles with an kinetic energy E of 2.5 keV and varying increments of mass from 10 to 100 AMU at 10 AMU increments. The nominal magnetic field in the inhomogeneous magnet is held to a maximum of 1.2 Tesla or less for the calculation of the example trajectories to represent a realistic magnet. This accounts for the deviation from a linear dispersion for the lowest mE/q particles as discussed previously.

Figure 4B:
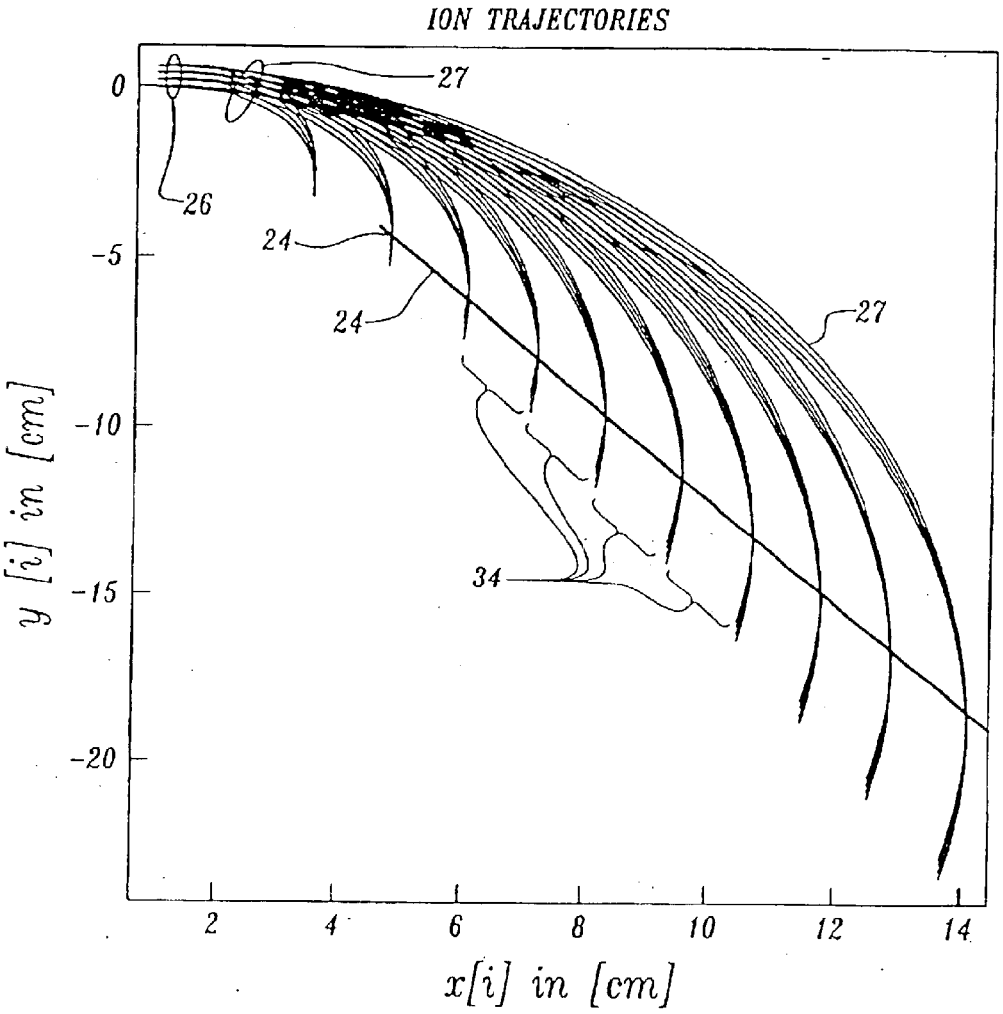
FIG. 4B is a graph of the trajectory and focusing position of charged particles with a constant energy differing from that of FIG. 4A and various masses traversing the same representative linear dispersion magnet.

FIG. 4B is a graph of the trajectory and focusing position of charged particles with a constant energy differing from that of FIG. 4A and various masses traversing the same example linear dispersion magnet. The trajectories 27 of collimated charged particles with parallel input angles 26 differ from those in FIG. 4A because they have a differing constant energy and set of set of mass-to-charge ratios. The characteristics of the linear dispersion magnet are identical using the example magnet that produced the example data of FIG. 4A. The separation 34 of the focus points 25 changes but still is in direct proportion to the fractional change in the mE/q. The focus points 25 lie on the same focal plane 24 as established by the example linear dispersion magnetic separator initially in FIG. 4A. This is a salient feature of the linear-dispersion magnetic separator: the focal plane is a property of the magnet and independent of mE/q. The example data plotted in FIG. 4B is for a family of charged particles with kinetic energy E of 500 eV and varying increments of mass from 100 to 1000 AMU in 100 AMU increments. The example magnet characteristics are identical to the example data of FIG. 4A.

Figure 5:
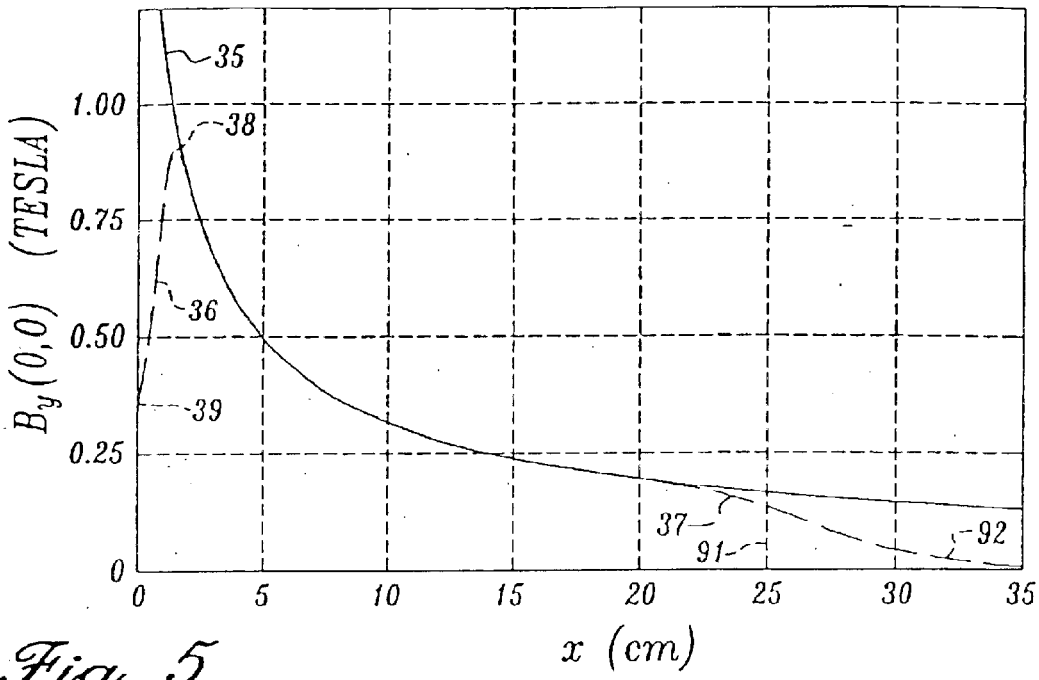
FIG. 5 is a graph of an example required theoretical magnet field necessary to achieve a focus plane and the magnetic field obtained from example poles profiles of the present invention shown in FIG. 3.

FIG. 5 is a graph of an example required theoretical magnetic field necessary to achieve a focus plane and the magnetic field obtained from example poles profiles of the present invention shown in FIG. 3. The desired field 35 has the dependence in x given by Equation (2). The example data 36, 37, and 38 is for a magnet with a pole length of 25 cm. The dashed line 36 is a plot of the actual calculated example linear-dispersion magnet sector giving trajectories shown in FIG. 4A and FIG. 4B. A minimum gap is required between two pole pieces and so the calculated field 36 reaches a maximum 38 within the magnet and then decreases to the entrance of the magnet 39 defined as x=0. The deviation of the modeled field 37 at large x is a result of the finite length of the magnet sector ending at x=25 cm 91. It is easily corrected by slight reductions in the gap near the pole trailing edge. Once outside of the magnetic separator the residual magnetic field 92 quickly decays.

Figure 6:
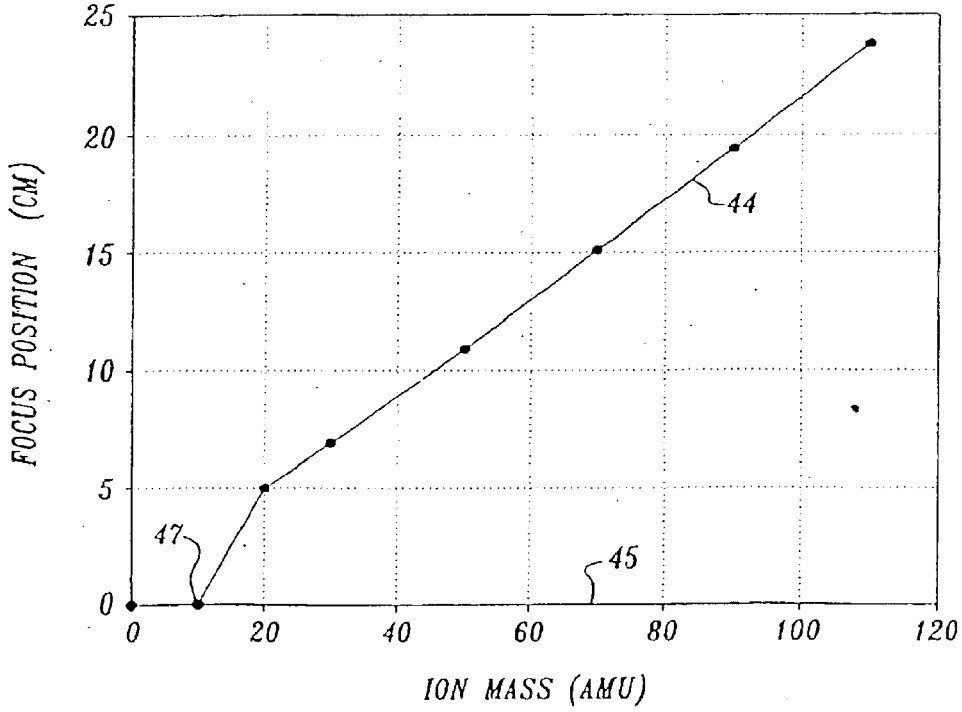
FIG. 6 is a graph of the focus location as a function of the charged particle mass-to-charge ratio for a representative linear dispersion magnetic separator in practice.

FIG. 6 is a graph of the focus location as a function of the charged particle mass-energy-to-charge ratio for a representative linear dispersion magnetic separator in practice. The focus position 44 is shown as a function of the charged particle mass-energy-to-charge ratio 45 for the magnetic separator. The specific example focus locations result from a magnetic field produced by the explicit pole profile shown in FIG. 3 and graphed in FIG. 6. Only at very low mE/q 47 at a fixed energy E does the focus position deviate from an intersecting plane. This is the result of the minimum gap requirement previously explained. The kinetic energy of the charged particles in the example data is 2.5 keV. The entrance charged particle angle of this particular linear dispersion example is 54 degrees from the focal plane which is along the longitudinal edge of the pole. This is in contrast to the uniform-field sector where the incident angle is at 45 degrees from the focal plane. The 54 degree angle is not a unique angle, but a result of the construction of this specific representative linear dispersion magnet.

Figure 8:
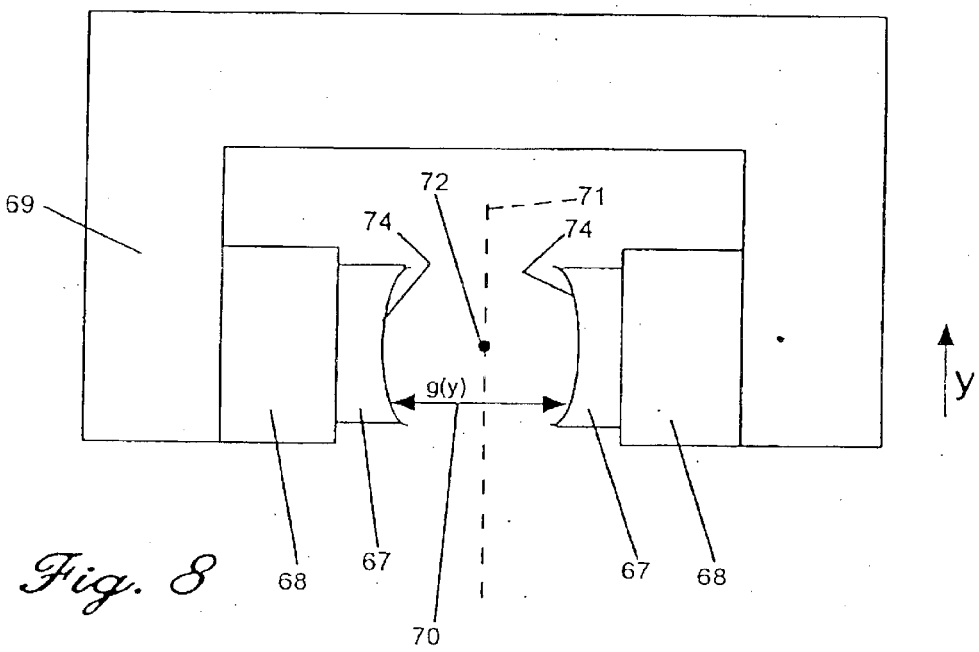
FIG. 8 is a schematic diagram of a representative linear dispersion magnetic separator as shown in FIG. 2 which incorporates a transverse field gradient to focus an uncollimated charged particle beam.

FIG. 8 is a schematic diagram of a representative linear dispersion magnetic separator as shown in FIG. 2 which incorporates transverse field gradients to focus an uncollimated charged particle beam. The schematic incorporates the same characteristics as that shown in FIG. 2. A highly magnetic permeable yoke 69 closes a magnetic circuit powered by permanent magnets 68 creating a field between poles 67 arrayed symmetrically about a centerline 71. The poles 67 in this configuration have nonparallel surfaces 74 that are symmetric about a centerline 71 bisecting the gap 70 g(y). The functional dependence of g(y) is chosen to provide focusing characteristics selected based on the specific conditions of the input charged particle beam 72. With charged particle beams which are not collimated this additional transverse focusing may be implemented to achieve the proper focus characteristics along the focal plane. This transverse dependent gap produces a magnetic field with either a linear or higher order gradient within the field. One skilled in the art can easily determine the transverse dependence required. Again, neither the yoke 69 nor the use of a permanent magnet are a requirement of the present invention as the characteristics necessary for the linear dispersion magnetic separator are established by the pole profiles.

Figure 7:
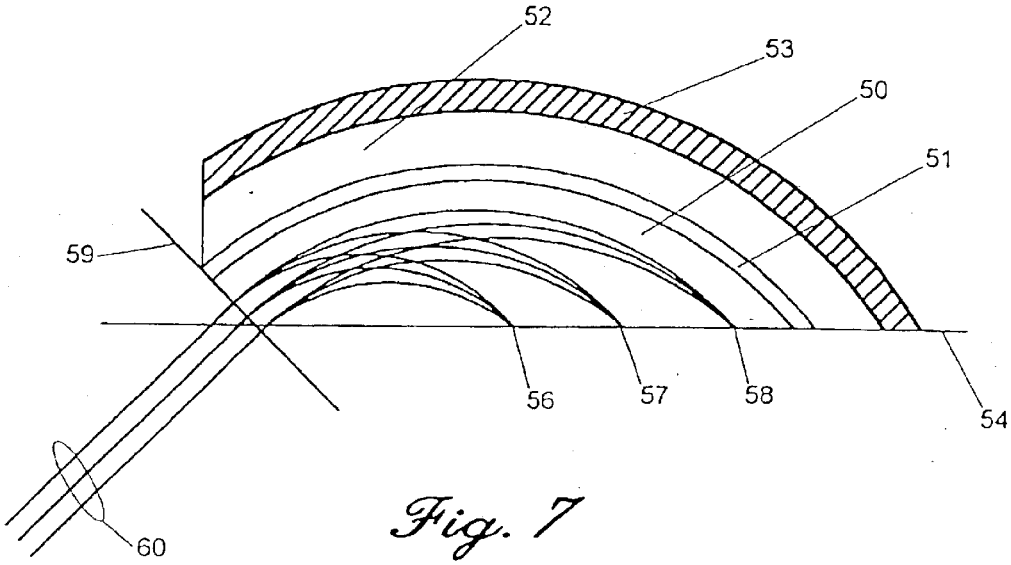
FIG. 7 is a schematic diagram of a representative linear dispersion magnetic separator according to an alternative embodiment of the present invention with curved pole pieces.

As one skilled in the art will readily appreciate, there are many various modifications of the above-described embodiments that may be made without departing from the spirit and scope of the invention. Particularly, many of the various embodiments of the uniform field magnet sectors are directly adaptable to the linear dispersion magnetic separator. Among the many various modifications possible is the use of the inhomogeneous linear dispersion magnetic field with a curved sector as shown in cross-section in FIG. 7. Here, in order to reduce the volume of the magnetic separator, the portion of the poles 50 which give rise to the inhomogeneous field, curve and thereby eliminate the portions of the sector that do not interact with the charged particles. The magnets 51 parallel to the plane of the page and may overlap the pole in order to minimize edge effects. The flux return yoke 52 is also curved to minimize volume while providing a return path on the curved back yoke 53 that does not adversely impact the poles 50 by creating magnetic flux leakage paths. A corner of magnetic separator 59 is removed to provide a perpendicular pole edge for the entrance of the charged particles 60. The charged particles 60 are focused along a plane 54 where the separation of the charge particle focus points 56, 57, 58 is determined by a linear function of their mass-energy-to-charge ratio. The shape of the poles 50 is such to give rise the inhomogeneous fields necessary to achieve the linear dispersion on a plane as previously described in this invention.

Likewise, in the same manner that uniform field magnetic separators of prior art may receive their magnetic field from one or more permanent magnets, electrical coils with current within the magnetic circuit the linear dispersion magnetic separator may receive its source of magnetic induction by any appropriate method.

Figure 9:
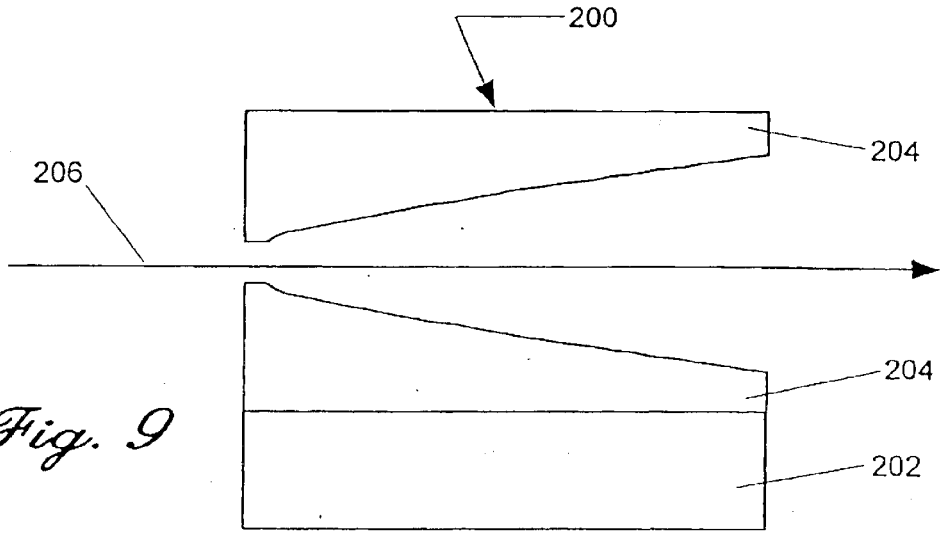
FIG. 9 is a schematic diagram of a representative linear dispersion magnetic separator according to an alternative embodiment of the present invention with curved pole pieces.

The magnetic separator of the present invention provides an inhomogenous magnetic field which linearly disperses charged particles by their mass-energy-to-charge ratio. For example, for charged particles having constant mass and charge, the separator disperses the particles linearly according to energy. Likewise, for charged particles of constant energy and charge, the separator disperses the particles linearly according to mass. Similarly, for charged particles of constant mass and energy, the separator disperses the particles linearly according to charge. The inhomogeneous magnetic filed can be produced from a variety of magnetic field sources. In addition to the separator embodiments described above, alternative embodiments of the magnetic separator of the present invention include separators in which the inhomogeneous magnetic field is produced by a magnet array, inhomogeneous magnet or magnets, and electrical coils. As noted above, the linear dispersion magnetic separator of the inventor can include a magnet having poles as illustrated in FIG. 9. As shown in FIG. 9, separator 200 includes magnet 202 and poles 204 through which charged particles travel (particle direction 206) and are linearly dispersed by their mass-energy-to-charge ratio. The number and position of permanent magnets 202 within the magnetic circuit can be varied and located anywhere within the magnetic flux path as described above for the prior art uniform-field magnetic sectors.

Figure 10:
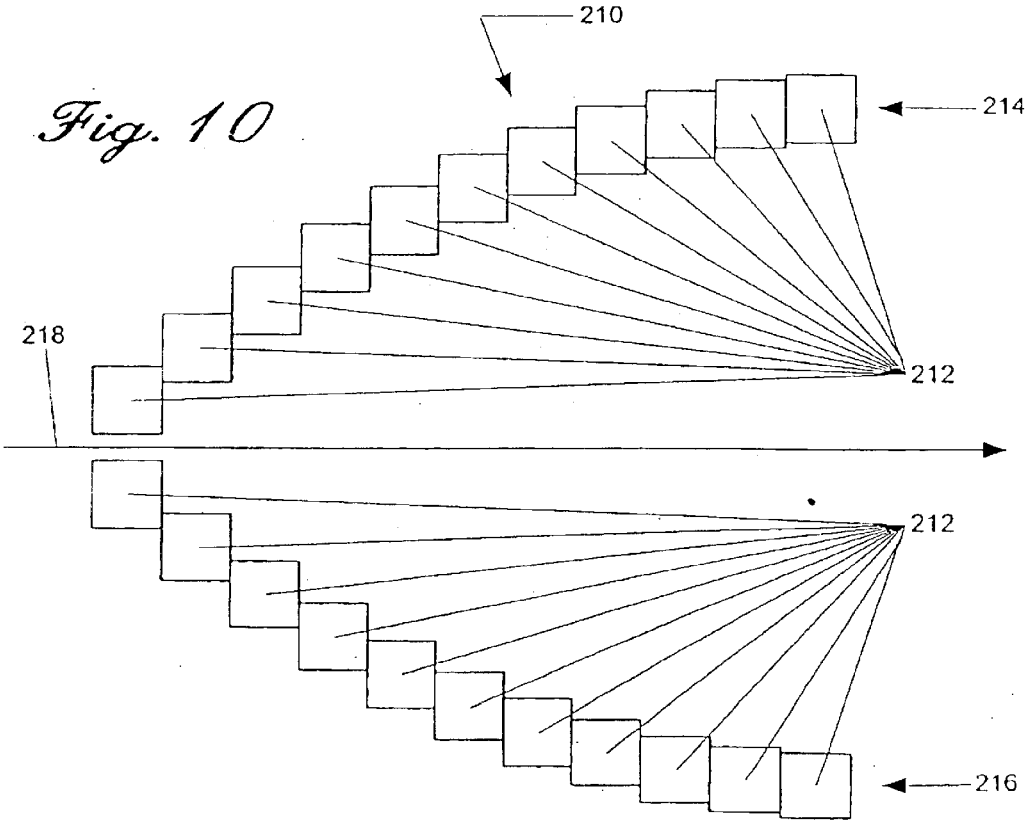
FIG. 10 is a schematic diagram of a representative linear dispersion magnetic separator according to an alternative embodiment of the present invention with a magnet array.

In another embodiment, the separator of the invention can produce the requisite inhomogeneous magnetic field for linear dispersion by a magnet array. Referring to FIG. 10, separator 210 includes individual magnets 212 arranged in an array and positioned to form a gap through which charged particles pass (particle direction 218). As illustrated in FIG. 10, magnet arrays 214 and 216 define the gap, which increases along the particle path, and provide the inhomogeneous magnetic field effective in linearly dispersing charged particles as described above.

Figure 11:
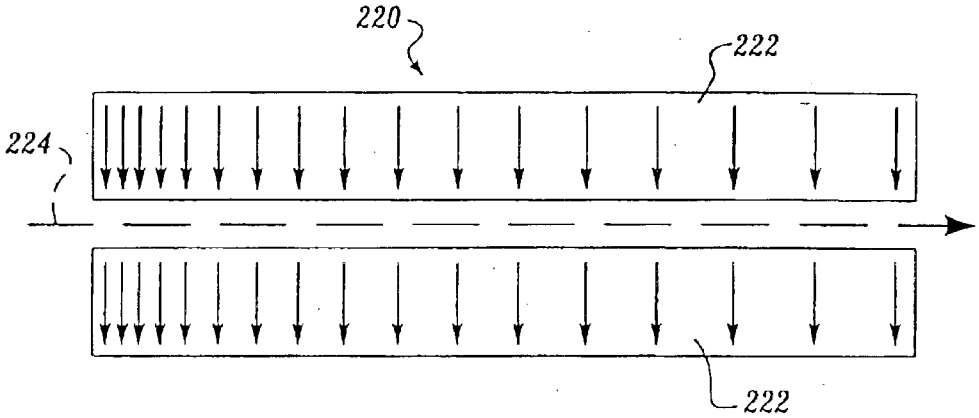
FIG. 11 is a schematic diagram of a representative linear dispersion magnetic separator according to an alternative embodiment of the present invention with inhomogeneous magnets.

Another embodiment of the separator produces the inhomogeneous magnetic field for linear dispersion by a pair of inhomogeneous magnets. Referring to FIG. 11, separator 220 includes inhomogeneous magnets 222 separated by a gap through which charged particles pass (particle direction 224). The magnetic field strength produced by the magnets decreases along the particle path to provide linear dispersion of the particles according to their mass-energy-to-charge ratio.

Figure 12:
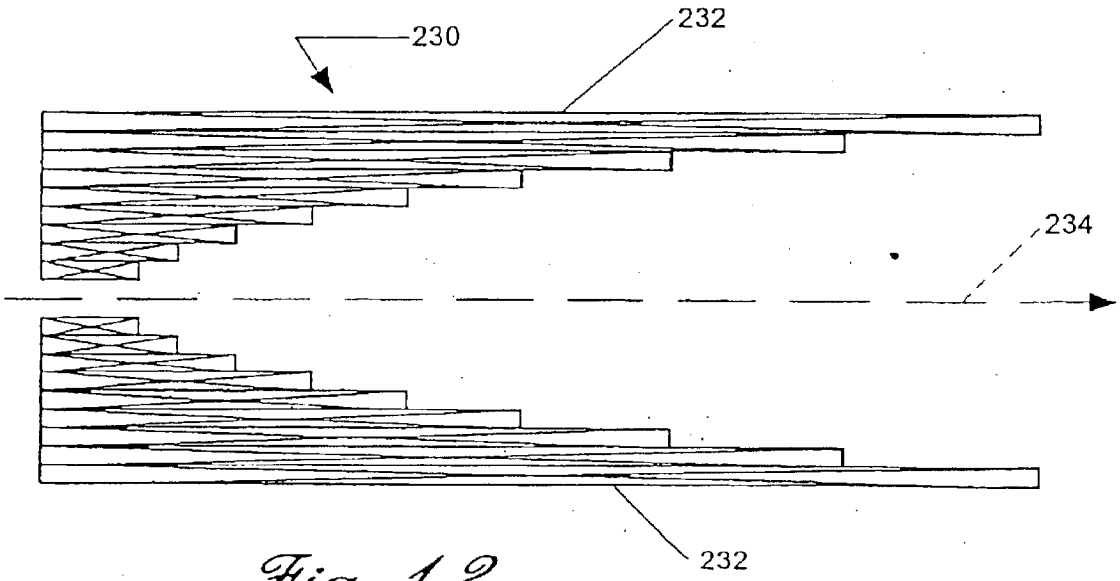
FIG. 12 is a schematic diagram of a representative linear dispersion magnetic separator according to an alternative embodiment of the present invention with an electrical coil.

In another embodiment, the magnetic separator of the invention can include an electrical coil for producing magnetic field for linear dispersion. As shown in FIG. 12, in this embodiment, separator 230 includes coils 232. The magnetic field strength produced by the coil decreases along the particle path (particle direction 234) to provide linear dispersion of the particles according to their mass-energy-to-charge ratio.

Figure 23:
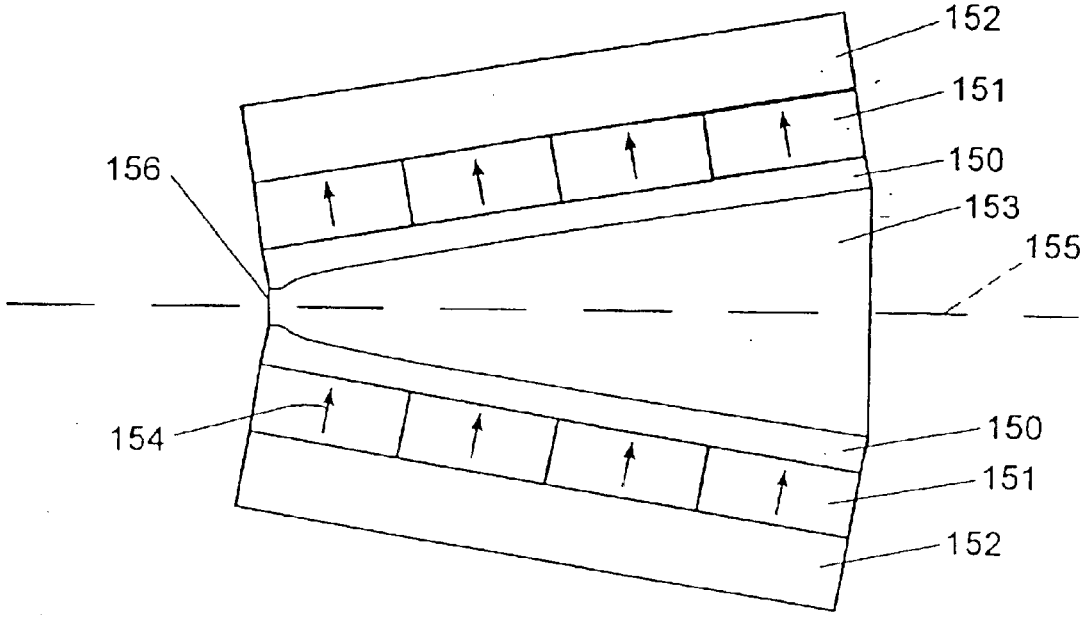
FIG. 23 is a schematic diagram of a representative linear dispersion magnetic separator according to an embodiment of the present invention with flux return and yoke with a fixed angle.

In another embodiment, the magnetic separator of the invention can include magnetic induction to the poles that is not perpendicular to a center midplane. As shown in FIG. 23, the magnetic induction powering the poles 150 can be provided by magnets 151 with magnetization vectors 154, which are not perpendicular to the bisecting midplane 155. The flux return 152 and back yoke 153 can be angled to provide an overall linear change in gap 156 along the length of the magnetic separator. The pole 150 profile is then created such that it is the only variance of the required pole gap profile from a straight line. In such an embodiment the amount and size of pole material 150 can be minimized.

The use of a linear-dispersion magnetic sector on a mass or energy spectrometer allows detection of the varying particle characteristics to occur along a single plane with a uniform separation over the mE/q region being interrogated.

Accordingly, in another aspect, the present invention provides linear dispersion mass and energy spectrometers that include the magnetic separator described above. The incorporation of the magnetic separator into a mass spectrometer provides a linear dispersion mass spectrometer having significant benefits and advantages compared to conventional mass spectrometers and analyzers including those that require scanning to mass analysis.

Identification and quantification of chemical species is crucial in numerous industrial processes and applications. Examples are on-line monitoring of processing, quality control, and monitoring of wastes. Detection and monitoring is also needed outside of industrial plants in the field. Examples include pollution control and monitoring, and remediation and cleanup. A further extension of field monitoring is remote sensing applications where the operator cannot be physically close to the measurement device. Examples are monitoring in remote locations, detection at the bottom of boreholes, and even extraterrestrial applications (e.g., Mars).

These applications require analytical instruments that (1) can tolerate physical abuse and misuse; (2) are stable for long time intervals; (3) are easy to use and maintain; (4) are relatively compact in size; and (5) are cost competitive with existing devices.

Mass spectroscopy is a well-established, commonly used research analytical tool that is very well suited to address the preceding needs for detection and monitoring. However, conventional mass spectrometers are inherently poorly designed for rugged industrial environments. Being more delicate they are also more difficult to operate generally requiring highly trained personnel. They tend to be expensive to fabricate, and expensive to maintain and repair. They also can be too large to conveniently fit in the processing lines of industrial plants. This has precluded mass spectroscopy from being widely accepted and used in the industrial community.

A need exists for a robust mass spectrometer (MS) suitable for industrial environments with a target cost comparable to similar analytical instruments (e.g., gas chromatographs). Such a MS will be inherently more robust in design by taking advantage of innovative approaches in the ion generation, separation, and detection. In addition, such a MS will be inherently more stable by usage of permanent magnets. Such a MS will also be less costly to manufacture, easier to operate and maintain, and more compact.

Mass spectroscopy, nuclear magnetic resonance (NMR) spectroscopy, and optical spectroscopy are the three major spectroscopic techniques used in the analysis of chemical compounds and mixtures. Like chromatography, but unlike NMR or optical spectroscopy, mass spectroscopy physically separates the components of a mixture for identification. This makes mass spectroscopy ideal when absolute identification of complex systems is required along with speed and sensitivity. It also explains its widespread appeal and usage in laboratories.

A basic mass spectrometer consists of six major subsystems: ionizer, ion optics, ion separator, ion detector, vacuum, and computer for control/analysis. The MS uses the principles of ionization, ion separation based on the mass-to-charge (m/z) ratio, and ion detection. In conventional systems one specific m/z ratio is selected at one point in time and the entire mass spectrum is recorded by scanning the mass separation field strength while holding the ion energy constant. While the general utility of these designs has been amply demonstrated in the research and laboratory environment, there are inherent major weaknesses in these designs for industrial usage. Some disadvantages of these designs are described as follows.

The ionizer subsystem can easily burn out or become contaminated, and requires precise electronic regulation. Its repair can be time consuming and expensive depending upon the particular design and construction of the unit.

Ion separators built around quadrupole technology require precise construction and alignment. They require RF drive electronics, are susceptible to contamination, and are not easily cleaned. They also cannot simultaneously pass all masses, which forces one to scan over the mass range. Ion separators built around electromagnets are heavy, require large regulated current supplies, and are not as mass-agile as a quadrupole-based separator.

Ion separators operating on traditional scanning technology must dwell on each mass for a minimum fixed period of time. As scan speed increases, the time available for collection diminishes and traditional instruments lose sensitivity or information. The fact that the duty cycle goes inversely with mass range also limits the detectivity (ions collected/amu) of a scanning instrument. In addition, scanning makes it difficult to capture transient samples. Hence, in dynamic environments, such as the use of the MS as a detector for a micromachined gas chromatograph, where minimal sampling and/or rapid detection is required, this scanning process can be a fundamental drawback.

Long-term mass stability can be an issue, especially when the instrument must be exposed to outside weather conditions. Conventional MS instruments must be frequently tuned and recalibrated to maintain optimum performance.

Electron multipliers used in the ion detection subsystem require high voltages and oil-free high vacuum conditions. Hence, they can contaminate easily and must be replaced. This requirement for oil-free high vacuum increases the cost, complexity, size, and weight of the MS instrument. The detection characteristics of these detectors also changes over time, which contributes to the problem of inadequate diagnostic stability.

The large dynamic range requirements ($1:10^5$) can be a challenge for conventional electron multiplier detectors especially once they have been exposed to other than perfect vacuum conditions. This can be also true for even microchannel plate (MCP)/phosphor screen/linear diode array detectors, which do not have the same stringent vacuum requirements.

Conventional MS instruments are typically not designed to operate in exterior environments where the temperature can vary substantially.

The high cost to manufacture, operate, and maintain conventional mass spectrometers, and their potential for high downtime, makes them unacceptable for industrial, field-deployed, or remote sensing applications. Therefore, a need exists for a mass spectrometer that avoids all these aforementioned problems and limitations. The present invention seeks to fulfill this need and provides further related advantages.

Figure 13:
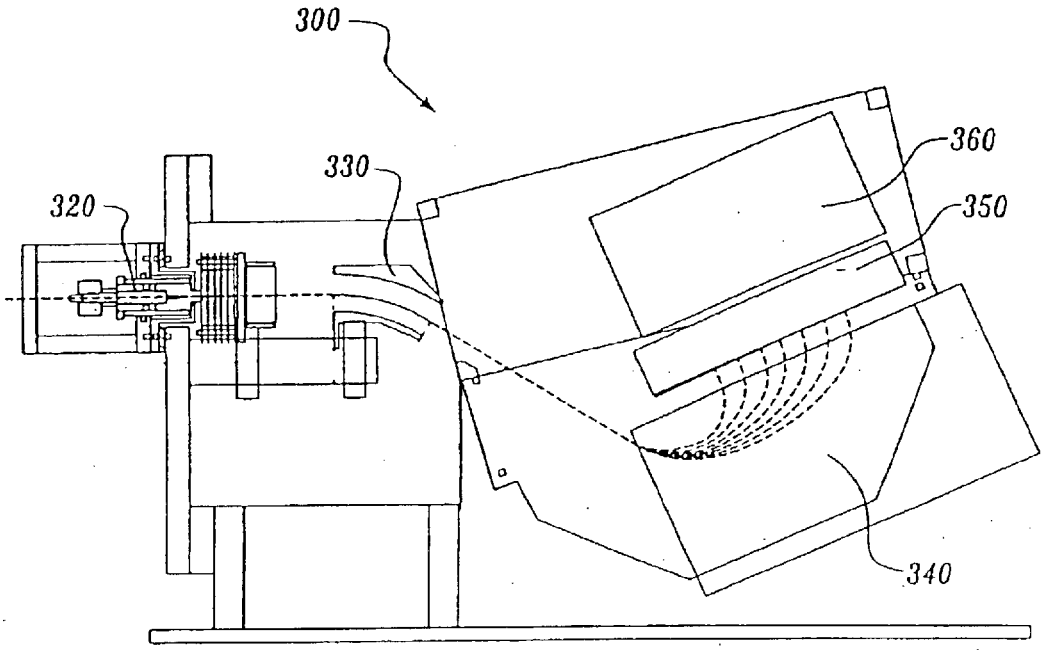
FIG. 13 is a diagram of a representative linear dispersion mass spectrometer formed in accordance with the present invention.

As noted above, in one aspect, the present invention provides a mass spectrometer that includes a linear dispersion magnetic separator. In addition to the separator, the mass spectrometer includes an ion source and an ion collector/detector. In a preferred embodiment of the mass spectrometer, the separator includes specially shaped magnet poles and permanent magnets to linearly disperse ions as a function of their mass. A diagram of a representative embodiment of a linear dispersion mass spectrometer of the invention is shown in FIG. 13. Referring to FIG. 13, representative mass spectrometer 300 includes ion source 320, ion optics 330, linear dispersion magnetic separator 340, ion detector 350, and associated signal processing unit 360.

In one embodiment, the mass spectrometer of the invention provide ions having a range of masses to the detector simultaneously. Conventional uniform field magnets can separate the ion beam in space, but the dispersion follows a $(mE/q)^{1/2}$ dependence. This is highly undesirable because it makes detection of high mass ions far more difficult. Hence, the mass spectrometer of the invention includes a linear dispersion magnetic separator (LDMS) as described above. In a preferred embodiment, the magnetic separator features specially shaped magnet poles and permanent magnets. The nonlinear pole shape produces a linear mass dispersion at the output of the magnet. The usage of permanent magnets simplifies the design, makes the device lighter and more compact, eliminates the need for power supplies and cooling water, and provides a more stable operation. The linear dispersion also makes it simple to correct for variations in instrument temperature.

Figure 14:
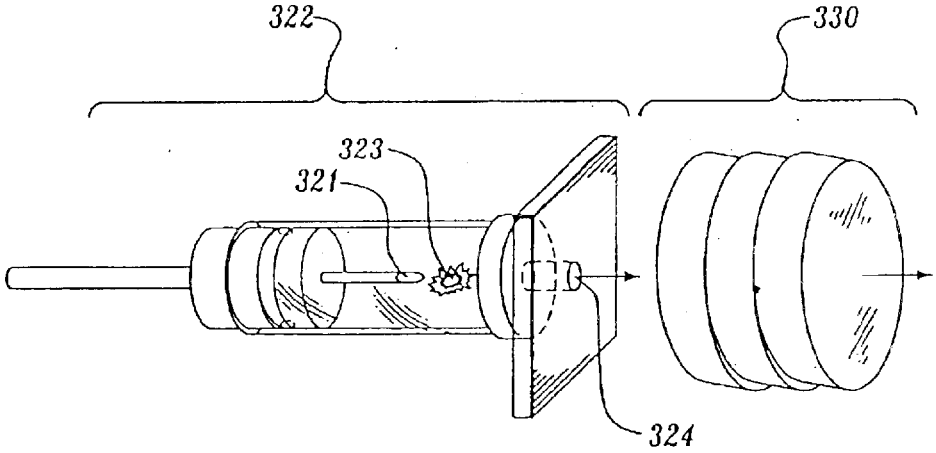
FIG. 14 is a diagram of a glow discharge system as an ionization source for a representative mass spectrometer formed in accordance with the present invention.

To eliminate the fragile ionizer and the need for high vacuum, the mass spectrometer of the invention can include a variety of ionizers (i.e., ionization sources), such as, for example, rare earth-coated filaments, Penning ionization, or glow discharge. In one preferred embodiment, the ionizer is a glow discharge source. A diagram of a glow discharge system as an ionization source in a representative mass spectrometer of this invention is shown in FIG. 14.

The modularity of the mass spectrometer of the invention makes it easy to use different ionizers. In another embodiment, the ionizer is a rare-earth-coated (REC) filament source (e.g., Y-coated Ir) featured in commercial units by Leybold-Inficon, Inc. These have demonstrated reliable operation from UHV to pressures up to 20 mTorr. In another embodiment, the ionizer is a Penning ionizer in which a metastable atom transfers its electronic excitation energy during a collision with an atom or molecule leading to its ionization. This process has been utilized in both research and commercial applications. Excited-state noble gases are typically used for this application. This approach has three advantages over conventional electron bombardment sources: (1) the metastable atoms are uncharged thereby eliminating space charge constraints to the metastable atom density, (2) the source does not operate in high vacuum, and (3) the metastable energy tends to overlap better with the energy dependence for molecular ionization than the energy distribution of electrons from a filament source. This latter feature enhances the efficiency of the ionization process. Because the analyte orifice is directly at the collision center, all analyte molecules are exposed to the excited rare gas beam. Calculations indicate an ionization efficiency of 0.0015 is possible for excited helium (He*), which is much higher than commercial RGA-quad systems that have typical ionization efficiencies of $\sim 10^{-5}$. One drawback with Penning ionization is the additional gas load flowing into the system.

The use of the LDMS greatly simplify the MS design, which leads to reduction in costs and applicability of the MS technology to industrial users. The manufacturing costs are lower because fabrication and alignment tolerances are reduced. Operating costs are reduced because maintenance will be easier, highly trained operators are not necessary, and there should be much less downtime.

Another noteworthy aspect of the mass spectrometer of the invention is that all major subsystems are modular. This makes it easy to service and upgrade or customize subsystems to suit different end-users. It also facilitates the manufacturing process since the subsystems can be manufactured by companies who are best suited for each subsystem and can manufacture them at the lowest cost. This modularity recognizes that the industrial MS represents the integration of widely different technologies (e.g., inhomogeneous magnetics, microfabrication).

Table I summarizes and compares the mass spectrometer of the present invention (i.e., Industrial MS) with conventional instruments (i.e., Conventional MS).

TABLE I

Comparison of Industrial MS With Conventional MS

| Subsystem | Conventional MS | Industrial MS |
|---|---|---|
| Ionizer | Hot filament source: Requires high vacuum. Easily burnt out or contaminated. GC compatible. | Rare-earth-coated (REC) filament source: Robust, mTorr vacuum acceptable. GC compatible. |

TABLE I-continued

Comparison of Industrial MS With Conventional MS

| Subsystem | Conventional MS | Industrial MS |
|---|---|---|
| | | Penning ionization source: Very robust, cannot be contaminated. Does not need precise electronic regulation. High ionization efficiency. GC compatible. Does require high gas loading. |
| Ion Optics | Can be complex in design. Can become contaminated. | Simple in design. Self-cleaning. |
| Ion Separator | Quadrupole-based system: Cannot simultaneously pass all masses. Requires RF drive electronics. Requires precise construction and alignment. Contamination and cleaning can be issues in industrial settings. Compact, less expensive units becoming available Electromagnet-based system: Heavy and big in size. Require large regulated current supply. Are not mass-agile. | Uses linear dispersion permanent magnets: All masses passed simultaneously. Provides constant reliable field for stable measurements. Construction tolerance relaxed. Alignment greatly eased. Contamination nonissue. Compact, lightweight. Does not require power supply or cooling water. Inexpensive component. |
| Duty Cycle | = 1/(mass range) | = 1 |
| Ion Detector | Electron multiplier: Provides high gain. Requires high voltage. Requires oil-free high vacuum. Contamination can be issue in industrial environments. Expensive to replace. | Uses Faraday cup: Enables simultaneous detection of masses. Inherently more robust, does not require high vacuum. Uses DC voltages only. Provides absolute mass signal. Using high gain op-amp yields comparable gain as electron multiplier. |
| Vacuum | Delicate components require oil-free high vacuum ($<10^{-9}$ Torr. Increases complexity and cost of overall MS system. | Only moderate vacuum needed: $\geqq 1 \times 10^{-4}$ Torr. REC filaments may permit using filtered mechanical pump. |

Although the size and dimension of the mass spectrometer of the invention is not critical to its operation, the mass spectrometer can be compact. In one embodiment, the footprint of the mass spectrometer is 1.5'×2.5'. The electronic control unit of the mass spectrometer fits quite easily in a one unit slot (5.25" high) of a standard 19' electronic rack. A second slot is needed for the high voltage supply for the glow discharge. The vacuum control system occupies 1½ slots in the rack. Data input and output is performed with an 386-IBM-PC.

A diagram of a representative mass spectrometer of the invention is shown in FIG. 13. Referring to FIG. 13, representative mass spectrometer 300 includes ion source 320, ion optics 330, linear dispersion magnetic separator 340, ion detector 350, and signal processing units 360. Briefly, ions formed in source 320 move through ion optics 330 (i.e., curved electrostatic sector plates) and into separator 340 (e.g., into a gap between a pair of magnets which linearly disperse the ions according to their mass-energy-to-charge ratio) and direct the ions to the ion detector 350 (e.g., a Faraday cup detector). The ion detector can include any suitable ion collector or detector known in the prior art. In a preferred embodiment, the detector is a position-sensitive detector having a planar detection surface. Signal processing units 360 read the charge accumulated at the detector. Each subsystem is briefly described below.

In one embodiment, the mass spectrometer of the invention includes a glow discharge ion source. A representative glow discharge source 322 is shown in FIG. 14. Referring to FIG. 14, diluent (e.g., helium, neon, argon, or xenon) and analyte (e.g., methanol, carbon dioxide, benzene, chloroform) flow through a small needle tube 321 into discharge region 323. Through adjusting the flow rate ($\approx 2$ $10^{-2}$ Torr l/sec), a low pressure condition ($P \approx 10^{-2}$–$10^{-3}$ Torr) is generated. This low pressure condition allows the formation of a DC glow discharge. The discharge burns between the positively charged needle 321 and the negatively charged output pin hole 324. It is started with a high voltage of 1.5 kV, and runs with 5–20 mA at ≈350V. The positively charged ions which are formed in the discharge leave the glow region through nozzle 325 (d=0.5 mm), and are focused with ion optics 330 downstream. The total ion current leaving the source has been measured to be least 0.5–2 $\mu$A depending on the glow conditions. After energy separation in the sector field ion currents of up to 200 nA remain in the beam.

Once the analyte is ionized, the ions are extracted out of the ionizing region with a set of ion optics. The ion optics include a combination of electrostatic ion optics and the linear dispersion magnetic separator described above, a so-called double focusing arrangement. The double focusing design meets the basic requirement for focusing ions of different masses in the same x-y plane.

In addition to an ion source, and linear dispersion magnetic separator, the mass spectrometer of the invention includes an ion detector, preferably a position-sensitive detector with integrated analog multiplexer. In one embodiment, the mass spectrometer of the invention includes a Faraday cup detector array (FCDA) for ion detection. Being an array of Faraday cups means the detector is position sensitive. The FCDA and associated electronic multiplexing unit have the unique capability to monitor the entire array (i.e., mass spectrum) truly simultaneously (duty cycle>96%). This is achieved by collecting the ions with a large number of small and electronically decoupled Faraday cups. Since a Faraday cup collects the charges independent of their charge state, each cup is both a collector and an integrator. The ability of the Faraday cup to integrate the charge, in combination with the electronic multiplexing unit that reads out (and empties) the cups very fast ($T<10^{-6}$ sec) compared to the charge integration time ($T=10^{-3}$ sec), provides the almost perfect duty cycle of the LDMS. The FCDA in combination with the magnetic separator design eliminate entirely the need for mass scanning.

In one embodiment, the FCDA has 128 units and a pitch size of about 820 $\mu$m. In another embodiment, the FCDA is a micromachined Faraday cup detector array with a pitch size of between about 150 and about 250 $\mu$m.

As noted above, the ion beam is separated according to its molecular weight in the magnet and the ions enter the Faraday cup detector array. Here, each of the cups collects the ion flux (for a specific mass/charge ratio) during the measurement time. Thereafter, each cup is read out sequentially by dumping its charge into an integrating chip. This sample-and-hold operational amplifier unit (BB IVC102) measures the accumulated charge and hands the result as a DC voltage over to an analog-to-digital converter on a DACA-board (NI-PC+) housed in an IBM-PC (386 Gateway).

In one embodiment of the mass spectrometer of the invention, the Faraday cup array consists of an array of 128 cups with active area dimensions of 700 $\mu$m×5 mm. Including the cup walls, the individual cell separation along the mass dispersion direction is 820 μm. This initial array was not microfabricated, which explains its relatively large cup size. The cup size of the array can be varied and can include arrays having a cup size of 100 to 250 μm.

In the operation of a representative mass spectrometer, an ion energy of 0–2 keV is used. The energy is provided by DC voltages, which makes the mass spectrometer simple and very cost effective. A DC-DC converter (EMCO Electronics, E, F-series) based electronic control unit generates the supply voltages for the ion optics. After passing the accelerator stage, the ions are bent by a low voltage electrostatic sector field ($\alpha$=31.8°) for energy separation before being injected into the magnetic field. The extractor voltage controls the ion energy, and thus the window of the mass range which is displayed on the detector. Hence, it can be adjusted to select any portion of the mass spectrum of interest.

In one embodiment, the mass spectrometer of the invention includes a linear dispersion magnetic separator having an inhomogeneous magnet, which linearly disperses ions on a detector. The mass window is limited by the physical size of the detector used as well as the housing lay-out. Generally, the mass range is from about 0 to about 1000 Daltons.

The magnetic separator is as described above and preferably includes a pair of permanent magnets (NdFeB) with vanadium permendur poles to separate the ions according to their mE/q ratio. The flux returns are made from low carbon steel pieces. In order to generate a linear dispersion with mE/q, it is necessary for the magnetic field to vary as $B(x)=B_o x^{3/4}$ where x is measured along the pole face. This can be accomplished by varying the gap g(x) between the poles such that $g(x)=x \tan (x^{1/4}$.

Figure 15:
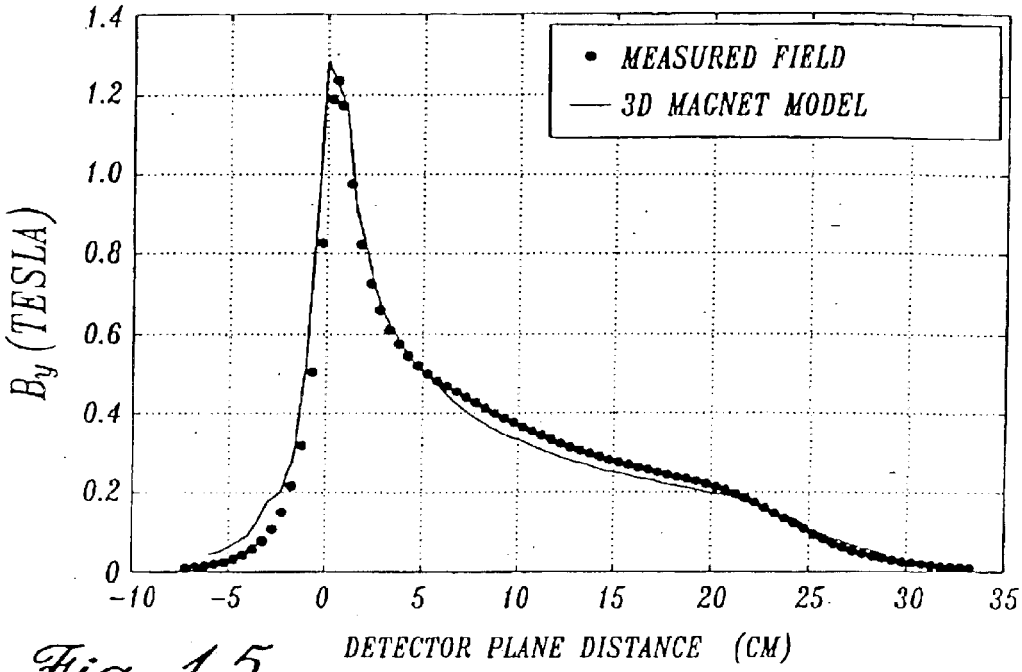
FIG. 15 is a graph that compares the calculated nonlinear magnetic field distribution and the measured field strength distribution of a linear dispersion magnet useful in the mass spectrometer formed in accordance with the present invention.
Figure 16:
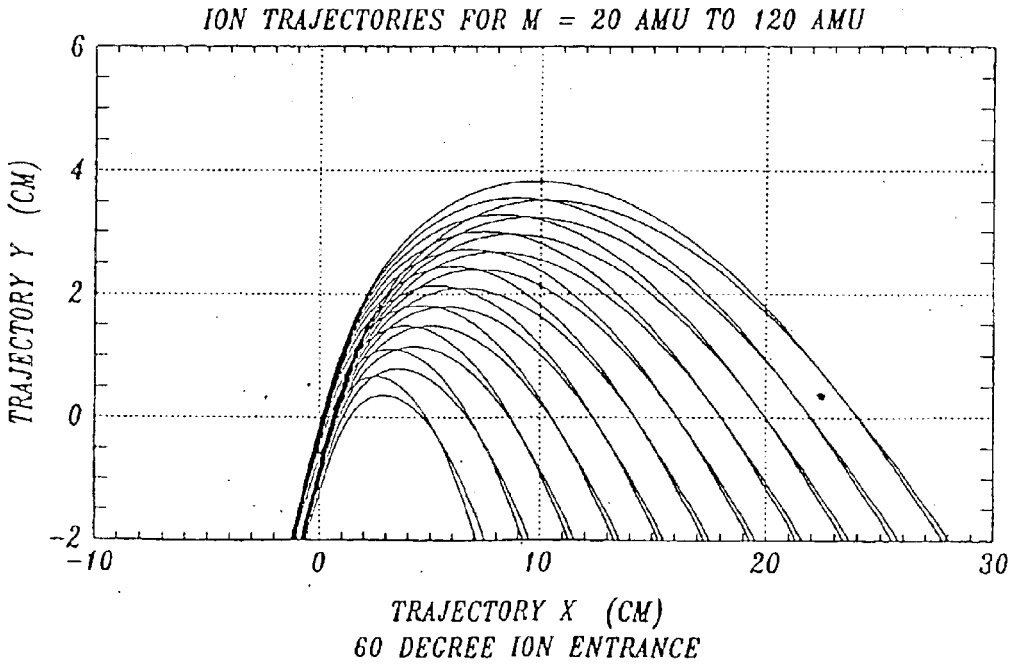
FIG. 16 is a plot of predicted ion trajectories through a linear dispersion magnetic separator useful in the mass spectrometer formed in accordance with the present invention.

In a representative mass spectrometer of the invention, the LDMS magnets have flat faces and are held at a constant distance of separation. The pole surfaces are machined with a nonlinear profile to obtain g(x). Because the magnet and poles are finite in length, the field distribution will deviate from the ideal one near the edges of the magnet. The deviation is illustrated in FIG. 15 which shows the calculated nonlinear magnetic field distribution and the measured field strength distribution of a linear dispersion magnet. FIG. 15 is a 2-D comparison of ideal magnetic field distribution with calculated one for a finite width pole. More detailed 3-D finite element analysis (FEA) was also performed using a commercial magnet analysis code (MAGNET) and compared with the measured field of the finished magnet system. The results are given in FIG. 16. The agreement is quite good despite the fact the model assumed slightly different geometry and parameter values than the representative mass spectrometer. FIG. 16 plots the predicted ion trajectories through the linear-dispersion magnetic separator for the mass spectrometer of the invention. Plotted are pairs of ions with the same mass but having different input trajectories. This 3-D simulation included fringe fields effects. As shown in FIG. 16, the ions are distributed linearly with mass. However, it is also apparent that the output focal plane is not quite along a straight line. This is due to the fringe fields. It is possible to straighten out the focal plane by fine tuning the pole shapes to compensate for the fringe fields.

Figure 17:
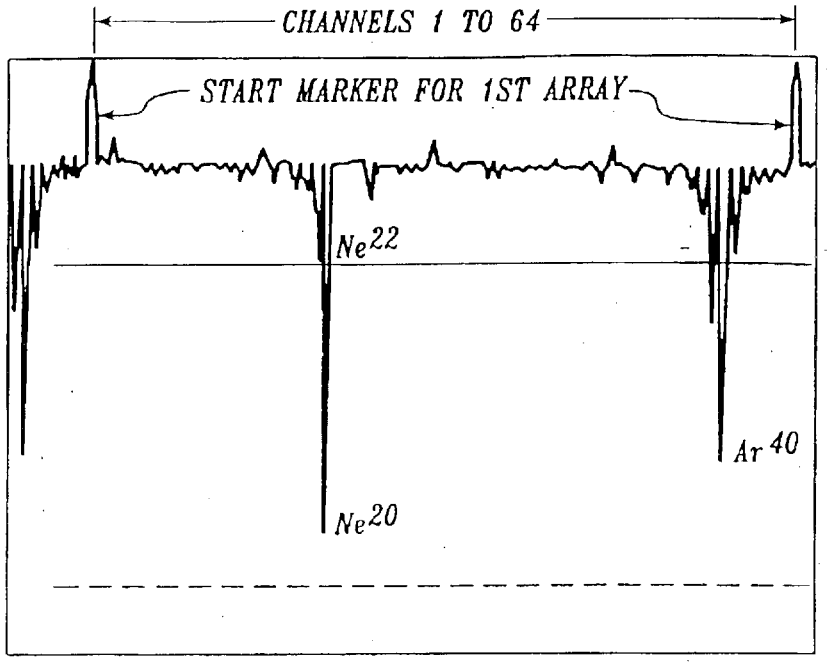
FIG. 17 is a mass spectrum of an argon/neon mixture obtained from a representative mass spectrometer of the invention.

FIGS. 17 through 22 show results of the output signal from a representative mass spectrometer of the invention having a FCDA as detector. The figures show each Faraday cup for different chemicals as a function of the molecular weight (in Daltons). The results experimentally verify the linear dispersion characteristics of the linear dispersion magnetic separator. FIG. 17 shows the mass spectrum of an argon/neon gas mixture ionized in a glow discharge source and detected with the 128-channel FCDA. Referring to FIG. 17, the mass spectrum of an argon/neon gas mixture ionized in a glow discharge source and detected with the 128-channel FCDA is shown. This plot is a hard copy from a storage oscilloscope which was used for data acquisitions before interfacing the LDMS with an IBM-PC. No background subtraction has been performed in this measurement. Each negative dip corresponds to the signal from one Faraday cup. This demonstrates a resolving power ΔM/M (M is a unit of mass) of a little over a factor of two. Plotted is the ion current measured in the individual Faraday cups as function of the sequential cup number. The ratio of the positions for the $Ne^{20}$, $Ne^{22}$, and $Ar^{40}$ signals all lie on a straight line showing a linear distribution of the molecular weight on the detector plane. This observed linear dispersion pattern proves the working principle of the linear dispersion magnet. The resolution ΔM/M is approximately 1, for example, the $Ne^{20}/Ne^{22}$ isotope can be resolved. In fact, the observed isotope ratio of 10:1 for the $Ne^{20}/Ne^{22}$ signal agrees well with the natural abundance ratio.

Figure 18:
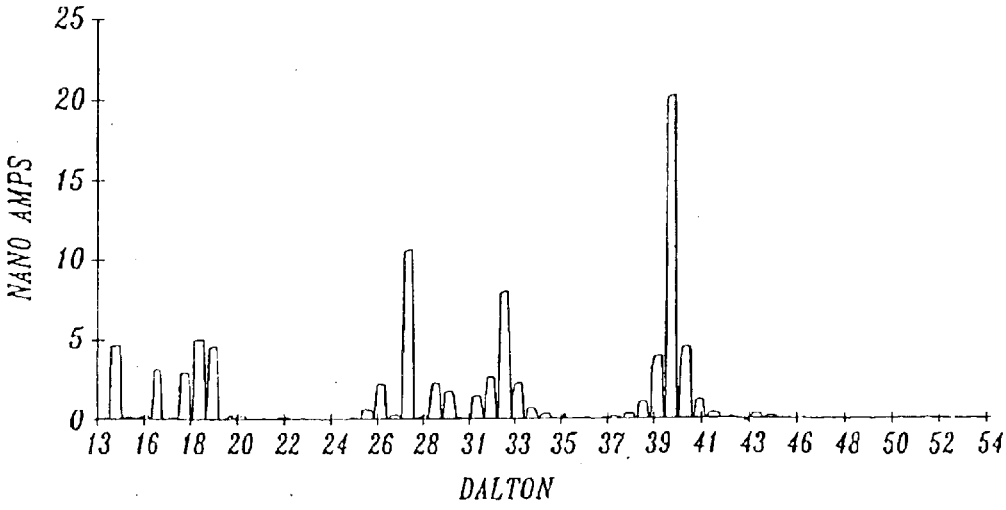
FIG. 18 is a mass spectrum of an argon glow discharge with a partial pressure of about 60% air mixed into the argon gas obtained from a representative mass spectrometer of the invention.

A mass spectrum of an argon glow discharge with at partial pressure of ≈60% air mixed into the argon gas is shown in FIG. 18. Referring to FIG. 18, the observed signal for water, nitrogen, and oxygen is a combination of their relative abundance and the difference in their ionization potentials. The elevated pressure during this measurement (P=2.5 $10^{-4}$ mbar) caused collision induced peak broadening. The $O_2$ abundance is increased due to the use of Teflon tubing in the gas inlet system. Teflon tubing is semipermeable to oxygen, thus increasing the $O_2$ partial pressure.

Figure 19:
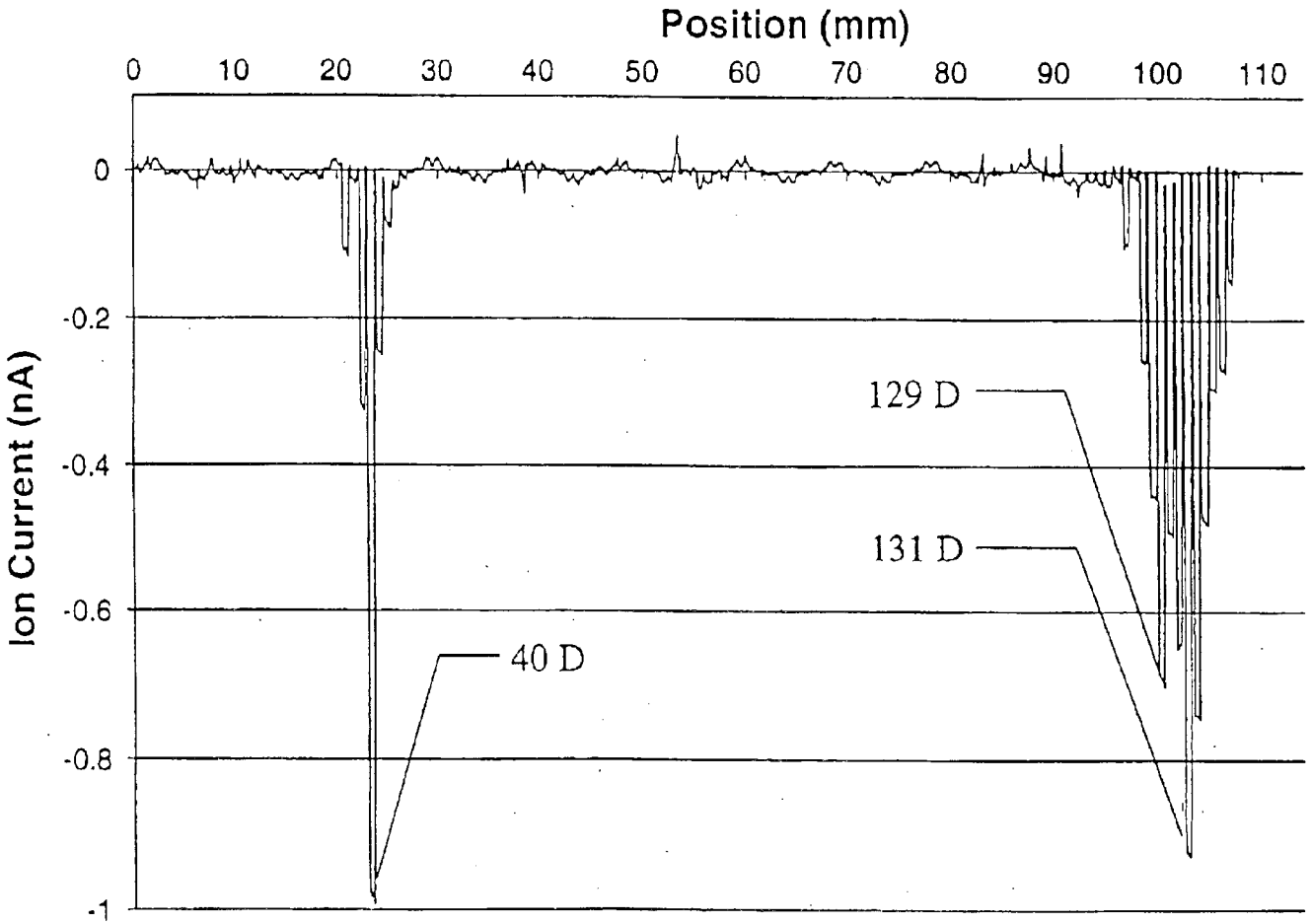
FIG. 19 is a mass spectrum of a xenon/argon mixture obtained from a representative mass spectrometer of the invention.

For heavier masses, the resolution of the mass spectrometer of the invention is lower, but still sufficient to resolve for example the xenon isotopes of mass 129 from 131 (see FIG. 19). Since there is approximately 1 Dalton/cup in a 128-cup FCDA, the resolution is inadequate to resolve the masses 131 from 132.

The mass spectrum observed with a xenon/argon mixture in the glow discharge is shown in FIG. 19. The Xe isotopes of mass 129 and 131 can be distinguished in the mass spectrum, while the isotopes on mass 131 and 132 can not be separated sufficiently under these ion optics and detector layout conditions.

Figure 20:
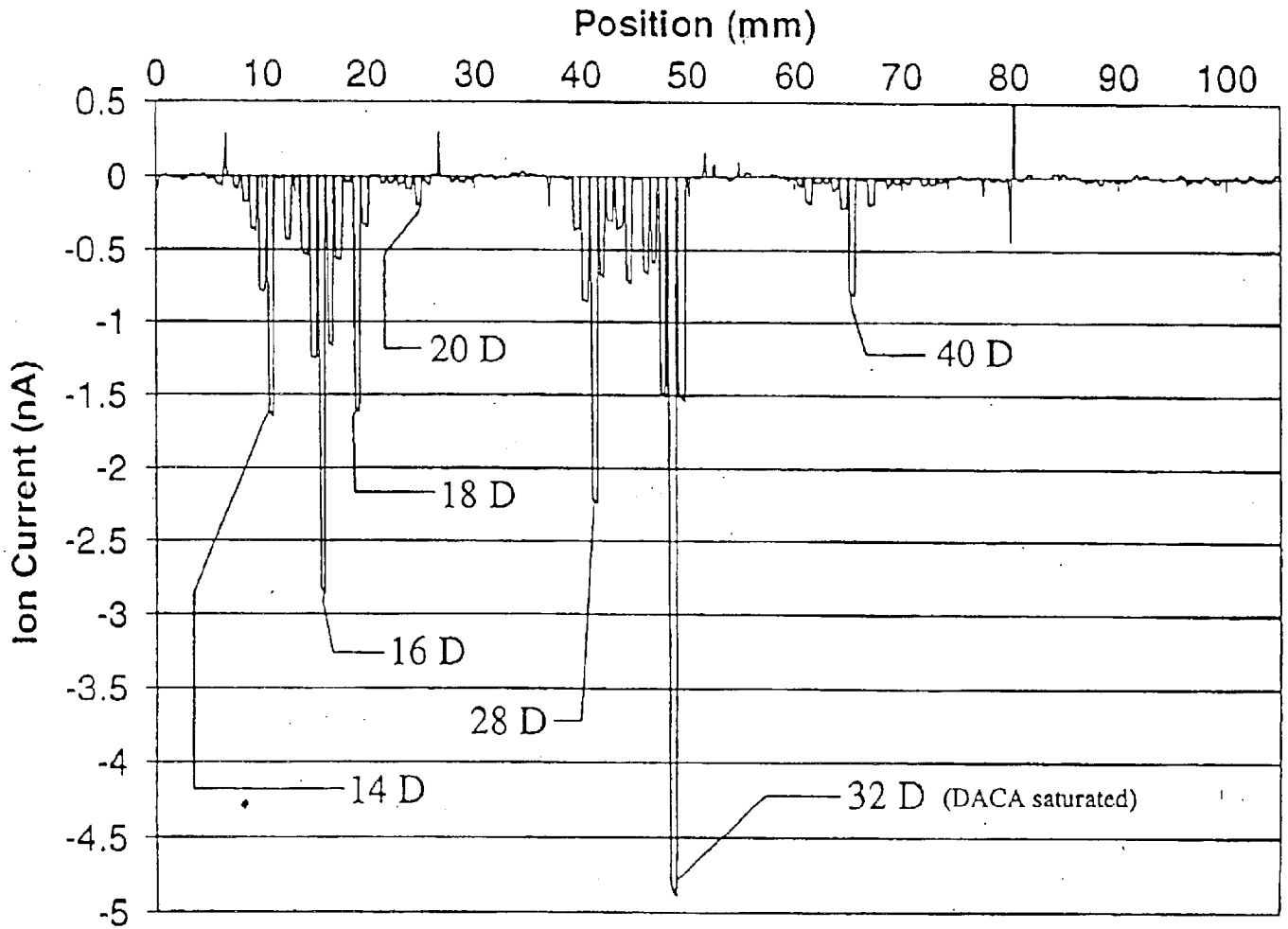
FIG. 20 is a mass spectrum of an argon/neon/air mixture (approximately 1:15:3) obtained from a representative mass spectrometer of the invention.

The mass spectrum of an argon/neon/air mixture (ratio approximately 1:15:3) in a glow discharge is shown in FIG. 20. (Note: the x-axis is given in mm to indicate the position on the detector plane). The total pressure in the system was $5\times10^{-4}$ Torr. The glow discharge was run with a current of 5 mA and ≈400 V. The ion energy was 1927 electron volts. The mass spectrum can resolve the basic constituents expected in the gas mixture. The signal to noise is (for a less dominant peak, such as the water peak) approximately 24:1 after acquiring the data for one read-out cycle (duration 0.094 seconds) and a second cycle for background subtraction. Averaging over multiple cycles increases the signal/noise ratio. The observed relative signal levels for different species is a function of the concentration of the analyte in the argon gas, as well as their relative ionization potentials. For example the high neon concentration in the gas mixture used to generate this figure is not seen in the mass spectrum.

In the operation of the mass spectrometer of the present invention, the magnetic separator linearly disperses ions onto the plane of the detectors The linear dispersion of the magnet has been studied with a large number of different molecules and atoms (e.g., helium, neon, argon, xenon, methanol, acetone, carbon dioxide, benzene, chloroform, hexane). These probes were introduced into the glow discharge for ionization. The known fragmentation peaks can be used as markers for the molecular weight. The position of the magnet relative to the ion beam, as well as the entrance angle of the beam into the magnetic field can be changed. Once the magnet position was optimized with respect to the resolution and linearity the magnet position was held constant. The use of rare gases, and carbon dioxide, instead of organic molecules, has the advantage of having access to higher molecular weights in a glow discharge ionization. The glow discharge ionization shows strong fragmentation for molecules heavier than about 50 D.

Figure 21:
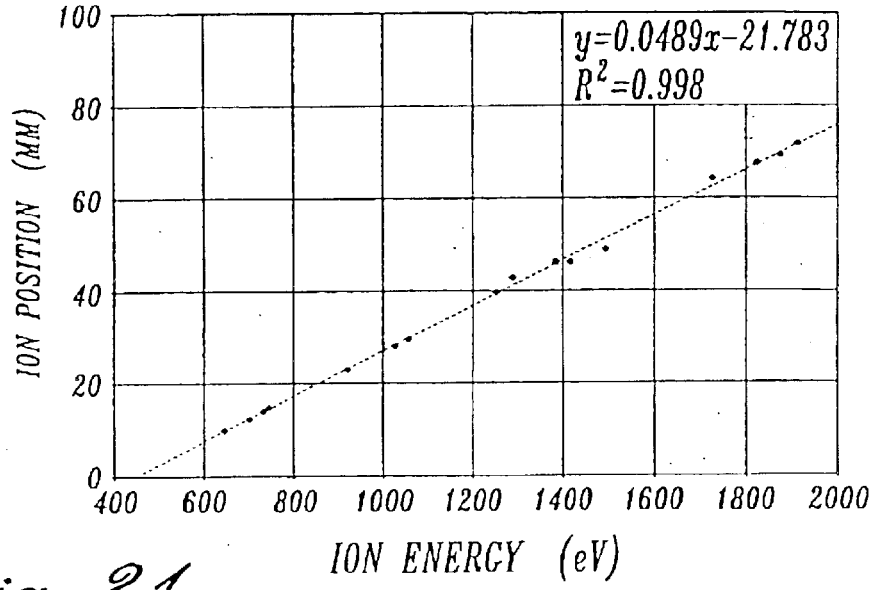
FIG. 21 is a graph of the position of an argon ion beam on the detector plane as a function of ion energy.
Figure 22:
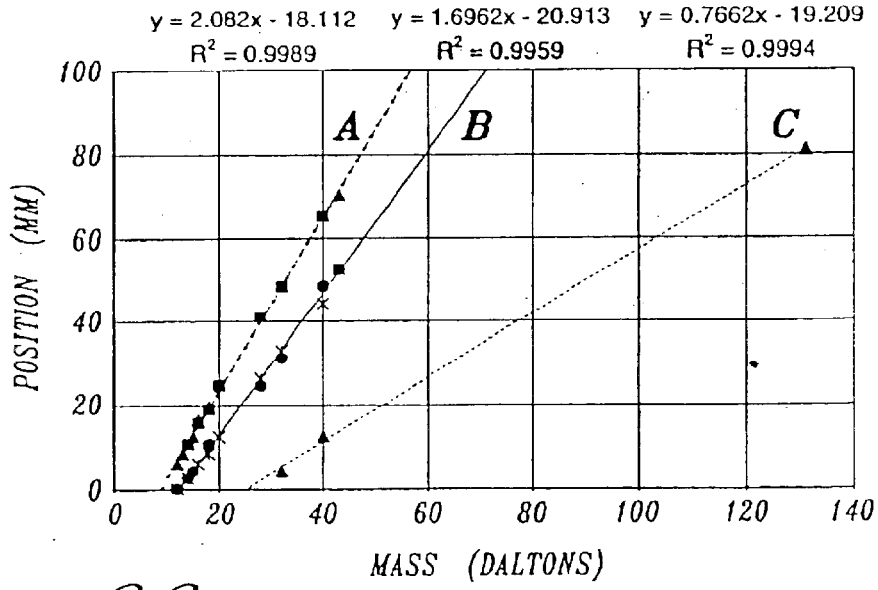
FIG. 22 is a graph of the position of the different molecular weight of components in an ion beam as a function of the molecular weight.

The inhomogeneous magnetic field used in the LDMS is designed to display the molecular weight distribution of the ions in the beam linearly on the detector plane (see FIGS. 21 and 22). There are two ways to verify the performance of the magnet: The Lorentz force $$\bar{F}=Q\bar{v}\times\bar{B} \tag{4}$$

changes the flight path of the ion perpendicular to both, the velocity of the particle and the magnetic field vector. Therefore, the energy of the ion is not changed during its passage through the magnetic field. The (local) curvature of the ion in the field is only dependent on the magnitude and direction of the (local) magnetic field vector, the charge state of the ion, and the product of its energy times molecular weight $$\overrightarrow{R(x, y, z)} = \text{constant}\frac{1}{\overrightarrow{B(x, y, z)n}}\sqrt{mE} \tag{5}$$

Since Equation 5 is symmetric in weight and ion energy, a linear display of the ion beam on the detector plane is therefore expected for either a constant energy with different molecular weights, or for different ion energies and constant molecular weight. The experimental verification of the predicted ion dependency for the two cases is shown in FIGS. 21 and 22.

Referring to FIG. 21, the position of an argon ion beam on the detector plane as function of the ion energy is shown in FIG. 21. The linearity of the display has been studied from 500 eV to 2000V. The higher end of the measurement has been limited by the length of the detector array used. The low energy limit is due to the strength of the permanent magnet used.

The positions of the different molecular weight of components in the ion beam as function of the molecular weight is shown in FIG. 22. Different ion energies (curves A, B, C) show different slopes for the position versus weight dependence. This relationship allows for the selection of the mass range of interest.

In the mass spectrometer of the invention, the position of the ion at the detector plane is function of only mass and energy, since the permanent magnet ensures a constant magnetic field. The measurements shown in FIG. 22 suggest a linear function for the position versus energy dependence $$P(m)=c(E)_1m+c_2 \tag{6}$$

with P(m) being the position of the ion on the detector plane, m being the molecular weight of the ion, E being the ion energy, $c(E)_1$ describing the position versus mass ratio as a function of the ion energy. $c_2$ is an offset arising from the finite curvature of the lightest particle in the magnetic field. As shown in FIG. 22, and expected from Equation 6, the slope of the curves A, B, C changes with the energy of the ions. Fitting the data shown in FIG. 22 to Equation 6 provides:

| Curve | Energy | Equation | R-value |
|---|---|---|---|
| A | 1861.33 eV | $P_A$(Dalton) = 2.082 Dalton − 18.112 [units: mm] | R2 = 0.998 |
| B | 1356.47 eV | $P_B$(Dalton) = 1.6962 Dalton − 20.913 [units: mm] | R2 = 0.9959 |
| C | 701.87 eV | $P_C$(Dalton) = 0.7662 Dalton − 19.209 [units: mm] | R2 = 0.9994 |

The mean of the offset $c_2$=19.41 mm. It should be noted that the y-axis intercept of the curves A, B, C are less than 10% apart from the mean. This condition is only given if the ion beams enter the magnetic field in the same position and angle (the offset is dependent on the entrance condition (position, angle) of the ion into the magnetic field).

The energy dependence of the slope $c(E)_1$ of the position versus mass curve (FIG. 22) is in itself a linear function of the ion beam energy $$c(E)_1=c_3E+c4 \tag{7}$$

Here c3=0.0011 [mm/(eV*Dalton)] and c4=0.014 [mm/Dalton], with an R-value of R=0.9746. Again the fit parameters taken from the measured data.

Therefore, the ion position on the detector can be described as a function of mass and energy in a single equation $$P(m)=c_3Em+c_4m+c_2 \tag{8}$$

since the constants $c_3$, $c_4$, $c_2$ are known. Equation 8 summarizes the content in FIGS. 21 and 22. Note that (i) the first derivative of Equation 8 leads to the different slopes observed in FIG. 22, with (ii) the offset given via $c_2$; and (iii) the first derivative of Equation 8 with respect to the molecular weight characterizes the energy selector capability of the magnet. Here the slope of the position versus energy curve is a linear function of molecular weight.

Having derived Equation 8 and the constants with the data shown in FIG. 22, the slope of the curve of the data displayed in FIG. 21 can be predicted. From Equation 8, the slope of the position versus energy curve can be predicted to be 0.044 (mm/eV). The best fit to the measured data gives 0.0489 [mm/eV]. This agreement is an independent test of Equation 8, especially since the data shown in FIGS. 21 and 22 were measured on different days.

Equation 8 can only be used to describe the experimental results if the entrance position and angle of the ions entering the magnetic field are constant. This can be achieved through careful monitoring the ratios of the ion energies to the energy selector potentials and an aperture between the energy selector and magnet.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A magnetic separator for charged particle beam separation, comprising means for providing an inhomogeneous magnetic field, and means for providing a homogeneous magnetic field, wherein a linear dispersion of charged particles proportional to their mass-energy-to-charge ratio is achieved by an inhomogeneous magnetic field in one plane and a homogeneous magnetic field in another plane.

2. The magnetic separator of claim 1 wherein the linear dispersion of the charged particles proportional to their mass-energy-to-charge ratio is along a plane.

3. The magnetic separator of claim 1 further comprising means for providing a transverse gradient magnetic field for focusing uncollimated charged particle beams.

4. The magnetic separator of claim 1 comprising a single magnet.

5. The magnetic separator of claim 4 wherein the magnet comprises two poles separated by a gap through which pass charged particle beams.

6. The magnetic separator of claim 4 wherein the gap separating the poles increases at a rate along the path of the charged particle beams such that the magnetic field decreases as a function of the distance from entrance of the magnet.

7. The magnetic separator of claim 1 wherein the magnetic field varies according to the function $B(x)=B_o x^{-3/4}$, where $B_o$ is a magnetic field constant chosen to match nominal magnetic field and x is a distance measured along the separator's centerline axis.

8. The magnetic separator of claim 5 wherein the gap between the poles varies according to the function $g(x)=\tan(x^{-1/4})$, where x is a distance measured along the pole surface.

9. The magnetic separator of claim 5 wherein the poles receive magnetic induction by an electric field.

10. The magnetic separator of claim 5 wherein the poles receive magnetic induction by permanent polarized hard magnetic material.

11. The magnetic separator of claim 10 wherein the magnetic material is selected from the group consisting of ferrite and rare-earth permanent magnetic materials.

12. The magnetic separator of claim 5 wherein the poles comprise a highly permeable soft magnetic material.

13. The magnetic separator of claim 10 wherein the soft magnetic material comprises an iron-cobalt alloy.

14. The magnetic separator of claim 13 wherein the iron-cobalt alloy comprises vanadium permendur.

15. The magnetic separator of claim 11 wherein the rare-earth permanent magnetic materials are selected from the group consisting of neodymium-iron-boron and samarium-cobalt materials.

16. The magnetic separator of claim 4 further comprising a flux return yoke.

17. The magnetic separator of claim 16 wherein the yoke comprises a highly permeable soft magnetic material.

18. The magnetic separator of claim 16 wherein the yoke comprises vanadium permendur.

19. The magnetic separator of claim 1 comprising a pair of inhomogeneous magnets each having a pole surface, wherein the pole surfaces are separated by a gap through which pass charged particle beams.

20. The magnetic separator of claim 19 wherein the magnetic field decreases as a function of the distance from entrance of the magnet.

21. The magnetic separator of claim 1 comprising a plurality of magnets dispersed in two parallel arrays separated by a gap through which pass charged particle beams.

22. The magnetic separator of claim 21 wherein the magnetic field decreases as a function of the distance from entrance of the magnet.

23. The magnetic separator of claim 21 wherein the gap separating the magnetic arrays increases at a rate along the path of the charged particle beams such that the magnetic field decreases as a function of the distance from entrance of the magnet.

24. The magnetic separator of claim 1 wherein the inhomogeneous magnetic field is produced from an electric coil.

25. The magnetic separator of claim 24 wherein the magnetic field decreases as a function of the distance from entrance of the magnet.

* * * * *